US010895371B2

(12) United States Patent
Matsuda et al.

(10) Patent No.: US 10,895,371 B2
(45) Date of Patent: Jan. 19, 2021

(54) LIGHTING DEVICE AND LIGHTING PANEL WITH MOUNTING MEMBER, CONNECTING MEMBER, AND ENGAGEMENT PARTS

(71) Applicant: KANEKA CORPORATION, Osaka (JP)

(72) Inventors: Kuniharu Matsuda, Tokyo (JP); Youichi Yamaguchi, Tokyo (JP); Akira Nishikawa, Kamikita-gun (JP)

(73) Assignee: KANEKA CORPORATION, Osaka (JP)

( * ) Notice: Subject to any disclaimer, the term of this patent is extended or adjusted under 35 U.S.C. 154(b) by 0 days.

(21) Appl. No.: 16/606,106

(22) PCT Filed: Dec. 13, 2017

(86) PCT No.: PCT/JP2017/044790
§ 371 (c)(1),
(2) Date: Oct. 17, 2019

(87) PCT Pub. No.: WO2018/211729
PCT Pub. Date: Nov. 22, 2018

(65) Prior Publication Data

US 2020/0149719 A1 May 14, 2020

(30) Foreign Application Priority Data

May 16, 2017 (JP) ..... 2017-097465

(51) Int. Cl.
*F21V 21/14* (2006.01)
*F21V 23/00* (2015.01)
(Continued)

(52) U.S. Cl.
CPC ..... *F21V 21/14* (2013.01); *F21V 23/001* (2013.01); *F21Y 2105/00* (2013.01); *F21Y 2115/20* (2016.08)

(58) Field of Classification Search
None
See application file for complete search history.

(56) References Cited

U.S. PATENT DOCUMENTS 4,688,869 A * 8/1987 Kelly ..... H01R 25/14 439/121
4,825,540 A * 5/1989 Kelly ..... H01R 25/14 29/857
(Continued)

FOREIGN PATENT DOCUMENTS

CN 201983038 U 9/2011
JP 2007250302 A 9/2007
(Continued)

OTHER PUBLICATIONS

English Machine Translation of WO 2016/140143 A1, published Sep. 9, 2016 (Year: 2016).*
(Continued)

*Primary Examiner* — Evan P Dzierzynski
*Assistant Examiner* — Keith G. Delahoussaye
(74) *Attorney, Agent, or Firm* — Alleman Hall Creasman & Tuttle LLP

(57) ABSTRACT

The present invention provides a lighting device in which a planar light-emitting panel is supported by, and can be easily attached to and detached from, a support member. The support member has a support side engagement part and covers a large part of a feeding wiring line. The lighting panel has a planar light-emitting panel and a mounting member. The planar light-emitting panel is attachable to the mounting member and has a panel side engagement part on its rear surface. The mounting member is fixable to the support member, and has first and second attaching side engagement parts. The first attaching side engagement part can engage the support side engagement part in a direction substantially orthogonal to the support member at a position
(Continued)

overlapping with the planar light-emitting panel. The second attaching side engagement part can engage the panel side engagement part in the orthogonal direction.

8 Claims, 25 Drawing Sheets

(51) Int. Cl.
*F21Y 115/20* (2016.01)
*F21Y 105/00* (2016.01)

(56) References Cited

U.S. PATENT DOCUMENTS

| | | | | |
|---|---|---|---|---|
| 2002/0064979 | A1* | 5/2002 | Zakerzewski | F21V 29/70 439/110 |
| 2008/0121146 | A1* | 5/2008 | Burns | A47F 5/101 108/23 |
| 2013/0107501 | A1* | 5/2013 | Ewald | A47F 5/0853 362/145 |
| 2013/0294079 | A1 | 11/2013 | Tran et al. | |
| 2014/0232546 | A1* | 8/2014 | Karaki | G09G 3/00 340/815.45 |
| 2015/0230317 | A1 | 8/2015 | Hayashi et al. | |

FOREIGN PATENT DOCUMENTS

| | | | |
|---|---|---|---|
| JP | 2012015075 | A | 1/2012 |
| WO | 2012158723 | A1 | 11/2012 |
| WO | 2016140143 | A1 | 9/2016 |
| WO | 2016140144 | A1 | 9/2016 |

OTHER PUBLICATIONS

English Machine Translation of WO 2016/140144 A1, published Sep. 9, 2016 (Year: 2016).*

International Bureau of WIPO, International Preliminary Report on Patentability Issued in Application No. PCT/JP2017/044790, dated Nov. 19, 2019, WIPO, 8 pages.

ISA Japan Patent Office, International Search Report Issued in Application No. PCT/JP2017/044790, dated Mar. 6, 2018. WIPO, 2 pages.

European Patent Office, Supplementary European Search Report Issued in Application No. 1791002, dated Jul. 7, 2020, Netherlands, 2 pages.

* cited by examiner

FIRST POSTURE (LINEAR POSTURE)

SECOND POSTURE (INTERSECTING POSTURE)

LIGHTING DEVICE AND LIGHTING PANEL WITH MOUNTING MEMBER, CONNECTING MEMBER, AND ENGAGEMENT PARTS

TECHNICAL FIELD

The present invention relates to a lighting device and a lighting panel provided with a planar light-emitting panel, such as an organic EL panel, an inorganic EL panel, and an LED panel in which LEDs are spread in a planar shape.

BACKGROUND ART

An organic EL panel is a planar light-emitting panel that emits light in a plane shape, and has a wide lighting range, and, therefore, is used as a lighting device (for example, Patent Document 1). Generally, this organic EL panel has a structure in which an organic EL element is stacked on a substrate such as a glass substrate and sealed, and in which power is supplied to the organic EL element.

PRIOR ART DOCUMENTS

Patent Documents

Patent Document 1: JP 2007-250302

DISCLOSURE OF INVENTION

Technical Problem

When an organic EL panel is used as illumination in a somewhat large space, such as a conference room, a plurality of organic EL panels are often used in parallel. In such a case, the organic EL panels are disposed at arbitrary positions. If the organic EL panels are attached in a line without gaps, there is a problem that an adjacent organic EL panel becomes an obstacle at the time of maintenance or replacement of the organic EL panel, and it is difficult to remove the organic EL panel to be replaced.

In view of the above, an object of the present invention is to provide a lighting device and a lighting panel in which a planar light-emitting panel is supported by a support member, and the planar light-emitting panel can be easily attached to and detached from the support member.

Solution to Problem

One aspect of the present invention for solving the above problem is a lighting device, including: a first lighting panel; a support member extending in a predetermined direction; and a feeding wiring line configured to feed power to the first lighting panel, the support member having a support side engagement part, the feeding wiring line being mostly covered with the support member, the first lighting panel including: a planar light-emitting panel having an emission surface; and a mounting member that attaches the planar light-emitting panel to the support member, wherein the planar light-emitting panel is attachable to and detachable from the mounting member, the planar light-emitting panel having a panel side engagement part on a rear surface thereof, wherein the mounting member is fixable to the support member at a plurality of positions in an extending direction of the support member, the mounting member having a first attaching side engagement part and a second attaching side engagement part, wherein the first attaching side engagement part is engageable with the support side engagement part at a position overlapping with the planar light-emitting panel when the emission surface is viewed from front, the first attaching side engagement part being engageable with the support side engagement part in a direction substantially orthogonal to the extending direction of the support member, and wherein the second attaching side engagement part is engageable with or disengageable from the panel side engagement part in the direction substantially orthogonal to the extending direction of the support member.

The "mostly" used here refers to a portion that occupies 90% or more of the whole.

The "direction substantially orthogonal to an extending direction" as used here is a direction orthogonal to the extending direction to an extent that it can be almost regarded as a direction orthogonal to the extending direction, and, specifically, a direction that forms an angle with the extending direction at 88 degrees or more and 92 degrees or less.

According to this aspect, since the part of the feeding wiring line is covered by the support member, it is possible to prevent the occurrence of an electric shock or the like caused by the user touching the feeding wiring line, and the safety is high.

According to this aspect, the mounting member can be attached to a desired position of the support member, and the planar light-emitting panel can also be installed according to the mounting member.

According to this aspect, since the fixing direction of the planar light-emitting panel and the fixing direction of the mounting member are both in a relationship of being substantially orthogonal to the extending direction of the support member, adjustment of the fixing position to the support member, and fixation to the support member can be prevented from being buffered.

According to this aspect, the mounting member is hidden by the planar light-emitting panel because it is engaged at a position overlapping with the planar light-emitting panel when viewed from the front, and the design is better than that of the prior art.

In a preferable aspect, the support side engagement part is electrically connected to the feeding wiring line, the support side engagement part being fittable to the first attaching side engagement part, and the first lighting panel and the feeding wiring line are electrically connected when the support side engagement part is fitted to the first attaching side engagement part.

According to this aspect, since the first attaching side engagement part functions as a power supply portion from the support member, attachment of the lighting panel to the support member and power supply from the support member to the lighting panel are facilitated.

In a preferable aspect, the support member includes two of the support side engagement parts, the two of the support side engagement parts are each electrically connected to the feeding wiring line and are each fittable to the first attaching side engagement part, and the first lighting panel and the feeding wiring line are electrically connected when the first attaching side engagement part is fitted to one of the support side engagement parts.

According to this aspect, position adjustment is possible by the position of the support side engagement part to which the first attaching side engagement part is fitted.

In a preferable aspect, the first attaching side engagement part includes an engagement unit including an engaging piece and an urging member, and when the mounting member is attached to the support member, the engaging piece is urged toward the support member by the urging member, so that the engaging piece is engaged with the support side engagement part.

According to this aspect, since the support side engagement part is engaged by the engaging piece urged by the urging member, the mounting member is less likely to be detached from the support member.

In a more preferable aspect, the support member includes two of the support side engagement parts, the two of the support side engagement parts including a first and a second support side engagement parts, the mounting member includes two of the engagement units, the two of the engagement units including a first and a second engagement units, the first engagement unit including a first engaging piece and a first urging member, the second engagement unit including a second engaging piece and a second urging member, the first and the second engaging pieces face each other with a space in-between so as to be urged to approach each other by the first and the second urged members respectively, and when the mounting member is attached to the support member, the support member is partially located between the first and the second engagement units while the first and the second support side engagement parts are engaged with the first and the second engaging pieces respectively.

According to this aspect, since two of the support side engagement parts are engaged with two of the engaging pieces, they are less likely to be detached.

In a preferable aspect, the lighting device further includes a second lighting panel provided in parallel with and adjacent to the first lighting panel in the extending direction of the support member, wherein the second lighting panel includes a second planar light-emitting panel having an emission surface, and a second mounting member having a first connecting unit and a second connecting unit, wherein the second connecting unit connected to the second planar light-emitting panel is configured to change a posture with respect to the first connecting unit, and wherein the second lighting panel is capable of changing its posture to a first posture and to a second posture by changing a posture of the second connecting unit with respect to the first connecting unit, the first posture being a posture in which the emission surface of the second planar light-emitting panel faces an identical direction to the emission surface of the planar light-emitting panel of the first lighting panel, the second posture being a posture in which the emission surface of the second planar light-emitting panel faces a direction substantially orthogonal to the extending direction.

According to this aspect, by setting the second lighting panel to the first posture, light can be emitted in the identical direction together with the lighting panel, and by setting the second lighting panel to the second posture, operation space and movement space of the lighting panel at the time of maintenance and the like can be secured.

A more preferable aspect is that the mounting member of the first lighting panel is movable in the extending direction when the second lighting panel takes the second posture.

According to this aspect, by setting the second lighting panel to the second posture, a movable range of the lighting panel can be secured, and attaching and detaching of the lighting panel to and from the support member are facilitated.

In a preferable aspect, the lighting device further includes a second lighting panel provided in parallel with and adjacent to the first lighting panel in the extending direction of the support member, wherein the second lighting panel includes a second planar light-emitting panel having an emission surface, wherein the lighting device further includes a connecting member that performs connection so that the emission surface of the first lighting panel and the emission surface of the second lighting panel are positioned on an identical plane.

According to this aspect, similar light can be emitted from each lighting panel.

A more preferable aspect is that the connecting member is formed of a flexible transparent resin, wherein the emission surface of the planar light-emitting panel is at least partially visible through the connecting member, and wherein the planar light-emitting panel is removable from the mounting member by elastically deforming the connecting member.

According to this aspect, since the connecting member is transparent and flexible, the connecting member can be hardly seen by the user, and by elastically deforming the connecting member, removal of the planar light-emitting panel of the lighting panel is facilitated.

In a preferable aspect, the support member has a plurality of the support side engagement parts provided at an interval in the predetermined direction, the mounting member has a first attaching side engagement part engageable with each of the plurality of the support side engagement parts, and a position of the first lighting panel with respect to the support member is adjustable by changing the support side engagement part engaged with the first attaching side engagement part.

According to this aspect, the position adjustment of the lighting panel with respect to the support member can be performed by selecting the support side engagement part with which the first attaching side engagement part is engaged among a plurality of the support side engagement parts. Accordingly, it is easy to dispose the lighting panel at a desired position.

One aspect of the present invention is a lighting device including: a lighting panel; and a support member extending in a predetermined direction, the support member having a plurality of support side engagement parts provided at an interval in the predetermined direction, the lighting panel including: a planar light-emitting panel having an emission surface; and a mounting member that attaches the planar light-emitting panel to the support member, wherein the planar light-emitting panel is attachable to and detachable from the mounting member, the planar light-emitting having a panel side engagement part on a rear surface thereof, wherein the mounting member includes: a first attaching side engagement part engageable with each of the plurality of support side engagement parts; and a second attaching side engagement part engageable with the panel side engagement part, and wherein a position of the lighting panel with respect to the support member is adjustable by changing the support side engagement part engaged with the first attaching side engagement part.

According to this aspect, the position adjustment of the lighting panel with respect to the support member can be performed by selecting the support side engagement part with which the first attaching side engagement part is engaged among a plurality of the support side engagement parts. Accordingly, it is easy to dispose the lighting panel at a desired position.

One aspect of the present invention is a lighting panel supported by a support member that extends in a predetermined direction and that has a support side engagement part, the lighting panel being connectable to a feeding wiring line, the feeding wiring line being mostly covered with the support member, the lighting panel including: a planar light-emitting panel having an emission surface; and a mounting member that attaches the planar light-emitting panel to the support member, wherein the planar light-emitting panel is attachable to and detachable from the mounting member, the planar light-emitting panel having a panel side engagement part on a rear surface thereof, wherein the mounting member is fixable to the support member at a plurality of locations in an extending direction of the support member, the mounting member having a first attaching side engagement part and a second attaching side engagement part, wherein the first attaching side engagement part is engageable with the support side engagement part at a position overlapping with the planar light-emitting panel when the emission surface is viewed from front, the first attaching side engagement part being engageable with the support side engagement part in a direction substantially orthogonal to the extending direction of the support member, and wherein the second attaching side engagement part is engageable with or disengageable from the panel side engagement part in the direction substantially orthogonal to the extending direction of the support member.

According to this aspect, it is possible to prevent the occurrence of an electric shock or the like due to the user touching the feeding wiring line, and the safety is high. Further, the adjustment of the fixing position to the support member and the fixation to the support member can be prevented from being buffered. Furthermore, since the mounting member is hidden by the planar light-emitting panel, the design is better than in the prior art.

Effect of Invention

According to a lighting device and a lighting panel of the present invention, a planar light-emitting panel is supported by a support member, and attachment and detachment of the planar light-emitting panel to and from the support member is easy.

BRIEF DESCRIPTION OF DRAWINGS

FIGS. 5A and 5B are explanatory views schematically showing a connection relationship between a support member of FIG. 3 and each lighting panel, wherein FIG. 5A is a cross-sectional view showing a structural connection relationship between the support member and each lighting panel, and FIG. 5B is an electrical circuit diagram showing an electrical connection relationship between the support member and each lighting panel.

FIGS. 7A and 7B are explanatory views of each posture of the lighting panel of FIG. 2, wherein FIG. 7A is a side view showing a state of a first posture, and FIG. 7B is a side view showing a second posture.

FIGS. 17A and 17B are explanatory views schematically showing a connection relationship between portions of the lighting device of FIG. 11, wherein FIG. 17A is an electrical circuit diagram showing an electrical connection relationship of a panel main body, and FIG. 17B is an electrical circuit diagram showing an electrical connection relationship between the lighting panels.

FIGS. 19A, 19B, and 19C are explanatory views showing a situation when the lighting panel is attached to the rail member, wherein FIG. 19A is a cross-sectional view of a main part immediately before the lighting panel is attached to the rail member, FIG. 19B is a cross-sectional view of the main part in the middle of attaching the lighting panel to the rail member, and FIG. 19C is a cross-sectional view of the main part in a state where the lighting panel is attached to the rail member.

FIGS. 24A, 24B, and 24C are explanatory views showing a situation when the lighting panel is attached to the rail member and the support member, wherein FIG. 24A is a cross-sectional view of a main part immediately before the lighting panel is attached to the rail member and the support member, FIG. 24B is a cross-sectional view of the main part in the middle of attaching the lighting panel to the rail member and the support member, and FIG. 24C is a cross-sectional view of the main part in a state where the lighting panel is attached to the rail member and the support member. Note that a structure of a wiring line and the like inside the support member is omitted.

FIGS. 27A and 27B are explanatory views of the lighting device of a fifth embodiment of the present invention, wherein FIG. 27A is a perspective view when the lighting device functions as a normal illumination in a first posture, and FIG. 27B is a perspective view when the mounting member is removed from the rail member in a second posture.

FIGS. 28A and 28B are explanatory views of a main part of a lighting device according to another embodiment of the present invention, wherein FIG. 28A is a side view in a case where a first connecting unit is straight, and FIG. 28B is a side view in a case where a second connecting unit is bent.

BEST MODE FOR CARRYING OUT THE INVENTION

Figure 2:
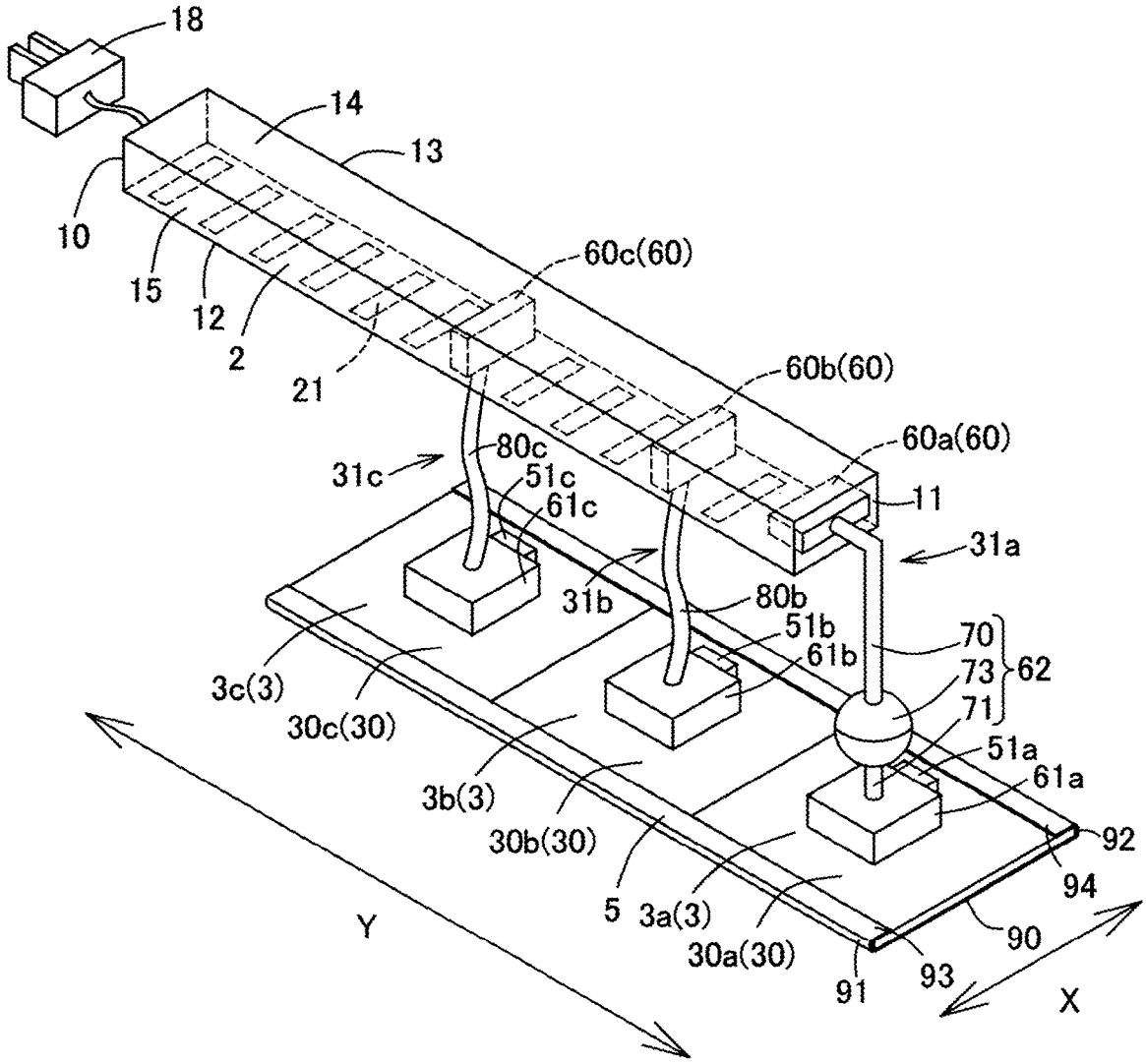
FIG. 2 is a perspective view of the lighting device of FIG. 1 as viewed from a rear surface side.

Hereinafter, embodiments of the present invention will be described in detail. Note that, in the description below, the posture shown in FIG. 2 is used as a reference unless otherwise noted. Further, an emission surface 55 side is the front, and a support member 2 side is the rear.

Figure 1:
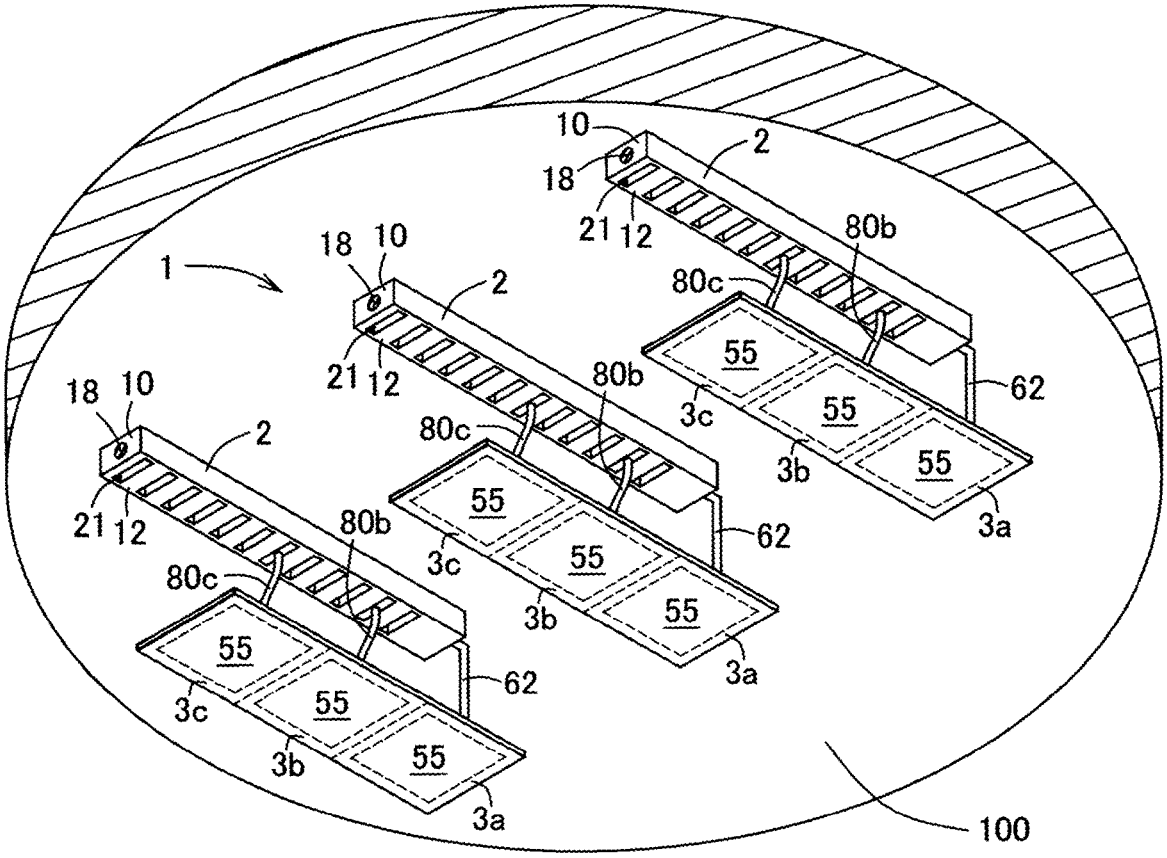
FIG. 1 is a perspective view schematically showing an installation situation of a lighting device according to a first embodiment of the present invention.

As shown in FIG. 1, in a lighting device 1 according to the first embodiment of the present invention, the support member 2 is attached to a mounting surface 100, such as a ceiling surface, a wall surface, or a floor surface, and the support member 2 supports one or a plurality of types of lighting panels 3 (3*a*, 3*b*, and 3*c*).

The description below is made for a case where the mounting surface 100 is a ceiling surface, that is, a case where the lighting device 1 is installed in a ceiling. Further, the description below is made for a case where the lighting device 1 includes three of the lighting panels 3*a* to 3*c*. The same members among the lighting panels 3*a* to 3*c* will be attached with same reference numerals, and omitted from the description. Further, the reference numerals of parts of the lighting panels 3*a* to 3*c* are represented by attaching "a", "b" and "c" to the end when components of the lighting panels 3*a* to 3*c* are indicated as necessary.

The lighting device 1 according to the present embodiment includes the support member 2, a feeding wiring line 25, the lighting panel 3, and a connecting member 5 as shown in FIGS. 2, 3, 5A, and 5B, and an attaching position of the lighting panel 3 to the support member 2 can be changed.

Figure 4:
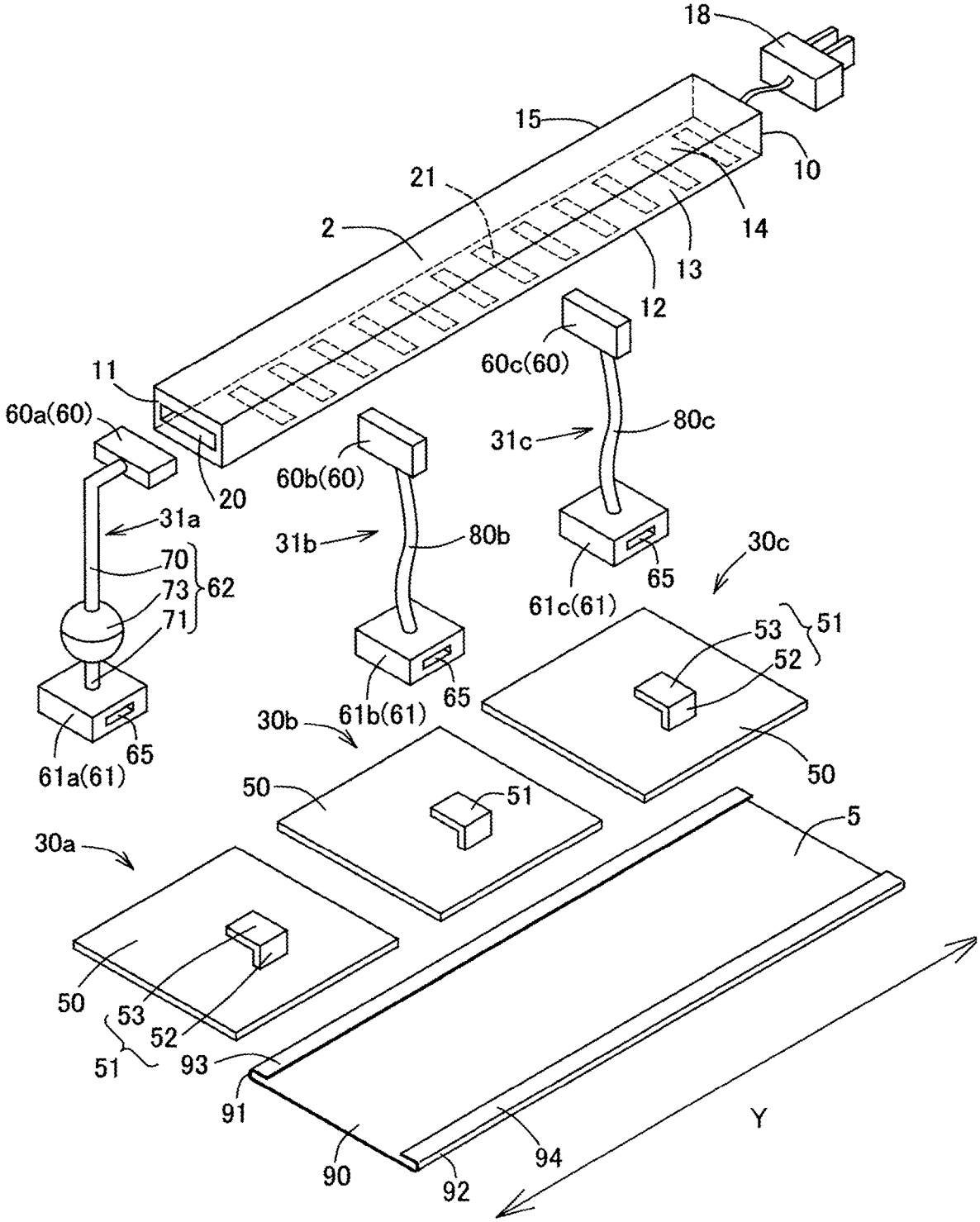
FIG. 4 is an exploded perspective view of the lighting device of FIG. 2 as viewed from a direction different from that of FIG. 3.

As shown in FIGS. 2 and 4, the support member 2 is an elongated body extending in a predetermined direction (hereinafter, also referred to as a length direction Y), and as an outline of the support member 2, includes a first end face forming portion 10 constituting one end face in an extending direction Y of the support member 2, a second end face forming portion 11 constituting the other end face, and side face forming portions 12 to 15 connecting sides of the first end face forming portion 10 and the second end face forming portion 11.

The first end face forming portion 10 is provided with a power source side connecting unit 18 connectable to an external power source or another one of the support member 2.

Figure 3:
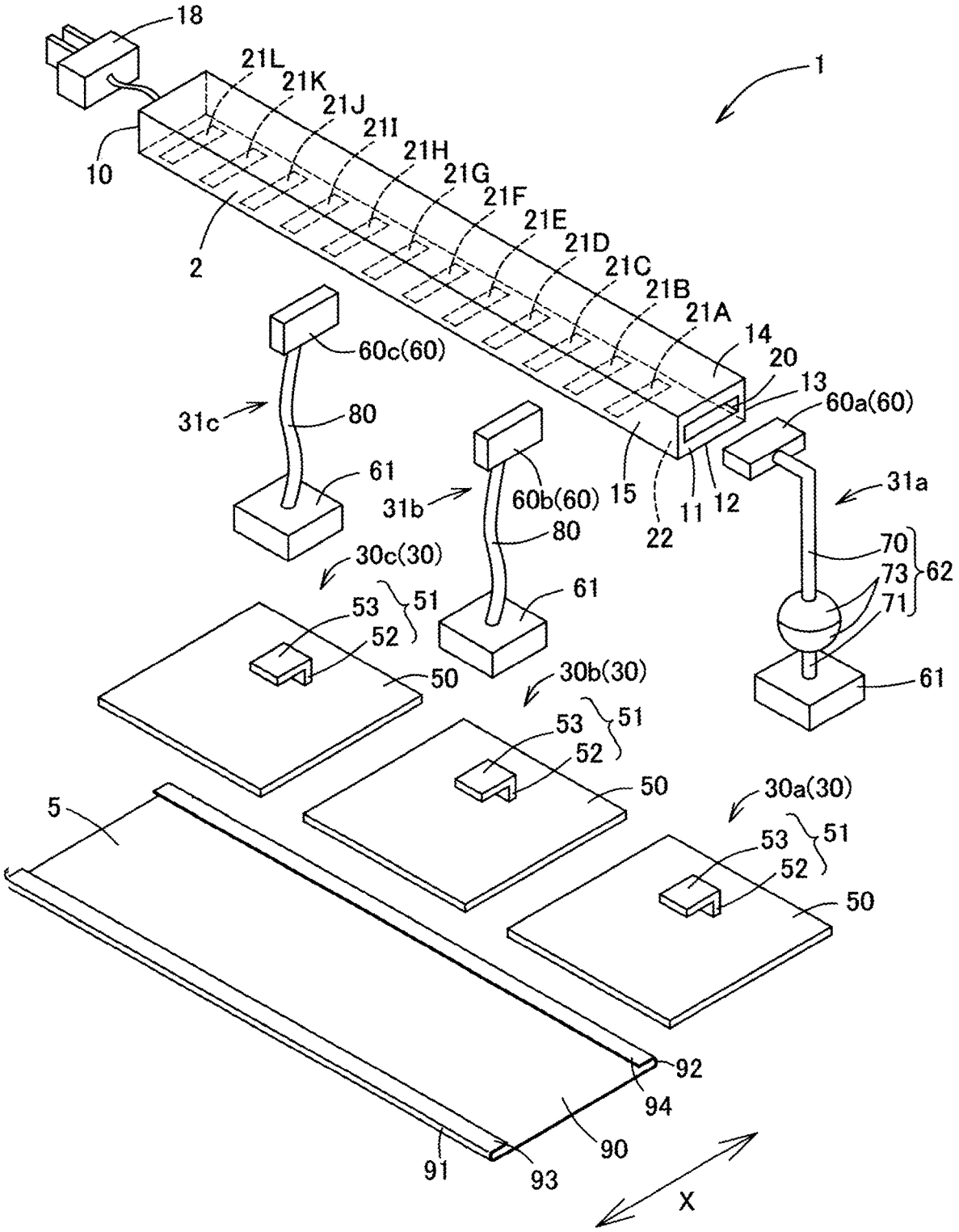
FIG. 3 is an exploded perspective view of the lighting device of FIG. 2.

As shown in FIG. 3, the second end face forming portion 11 includes an end face side engagement part 20 (support side engagement part) capable of engaging with a first attaching side engagement part 60*a* of the lighting panel 3*a*.

The end face side engagement part 20 is a fitting hole having a depth in the length direction Y and capable of being fitted to the first attaching side engagement part 60*a* of the lighting panel 3*a*, and is also a feed hole capable of feeding power to the lighting panel 3*a* by being fitted to the first attaching side engagement part 60*a*.

A side face forming portion 14 is a top face forming wall portion that constitutes a top face, and can be attached to the mounting surface 100 by an attaching means (not shown).

The side face forming portion 12 is a bottom surface forming wall portion constituting a bottom surface as shown in FIG. 3, and includes a plurality of side face side engagement parts 21 (21A to 21L) (support side engagement parts) engageable with first attaching side engagement parts 60*b* and 60*c* of the lighting panels 3*b* and 3*c*.

The side face side engagement part 21 is a fitting hole having a depth in a direction orthogonal to the length direction Y and capable of being fitted to the first attaching side engagement parts 60*b* and 60*c* of the lighting panels 3*b* and 3*c*, and is also a feed hole capable of feeding power to the lighting panels 3*b* and 3*c* by being fitted to the first attaching side engagement parts 60*b* and 60*c*.

The engagement parts 20 and 21 both function as a connector with the lighting panel 3 and are not particularly limited as long as they can be engaged with part of the lighting panel 3. In the present embodiment, the engagement parts 20 and 21 are recessed female terminals, and, for example, a USB port and the like can be employed.

Figure 5A:
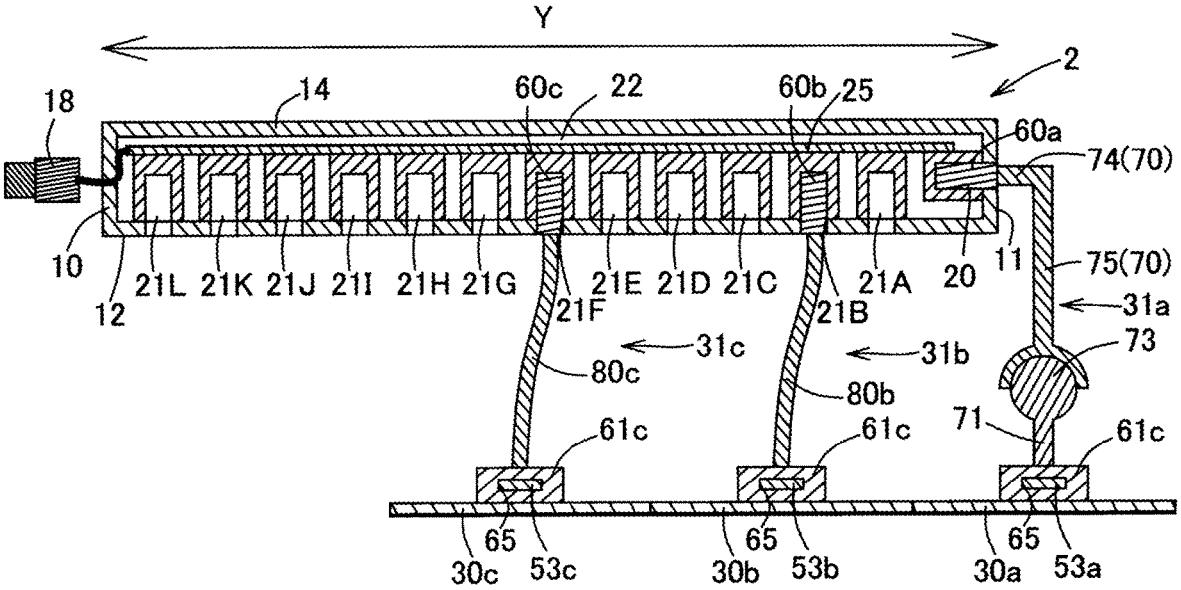

In wiring space 22 surrounded by the forming portions 10 to 15, as shown in FIG. 5A, a feeding wiring line 25 connectable to an external power source is incorporated.

Figure 5B:
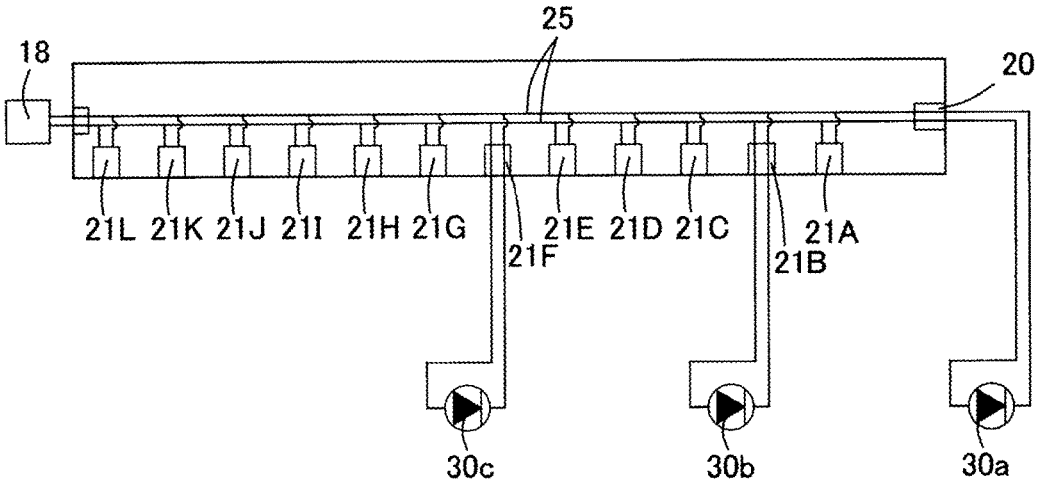

The feeding wiring line 25 is mostly covered by the forming portions 10 to 15 forming an outline of the support member 2. The feeding wiring line 25 is connected to the engagement parts 20 and 21 at the middle or end, and the engagement parts 20 and 21 are electrically connected in parallel to the power source side connecting unit 18 via the feeding wiring line 25 as shown in FIG. 5B.

The lighting panels 3 (3*a* to 3*c*) are provided with planar light-emitting panels 30 (30*a* to 30*c*) and mounting members 31 (31*a* to 31*c*) as main component members as shown in FIG. 3.

The planar light-emitting panel 30 is a plate-like panel which spreads in a planar shape and emits light in a plane shape, and is specifically an organic EL panel. That is, the planar light-emitting panel 30 incorporates an organic EL element provided with a light-emitting functional layer including two electrodes facing each other and an organic light-emitting layer sandwiched between two electrodes, and can emit diffused light.

As shown in FIGS. 1 and 3, the planar light-emitting panel 30 is mainly configured with a panel main body 50 incorporating an organic EL element and a panel side engagement part 51, and has the emission surface 55 on one main surface side.

The panel side engagement part 51 is a panel side power supply portion electrically connected to the organic EL element incorporated in the panel main body 50. As shown in FIG. 3, the panel side engagement part 51 is an engaging piece having an "L" shape in the side view positioned on the other main surface side (the opposite side to the emission surface 55) of the panel main body 50, and includes a vertical wall portion 52 provided to stand from the rear of the panel main body 50, and an insertion part 53 folded from a tip in a standing direction of the vertical wall portion 52.

The mounting member 31*a* (second mounting member) is a member for attaching the planar light-emitting panel 30*a* to the end face side engagement part 20. As shown in FIGS. 3 and 4, the mounting member 31*a* includes a first attaching side engagement part 60, a second attaching side engagement part 61, and a connecting unit 62 for connecting the first attaching side engagement part 60 and the second attaching side engagement part 61.

The first attaching side engagement part 60 is a power supply portion that makes a pair with the end face side engagement part 20 or each of the side face side engagement parts 21 (21A to 21L) of the support member 2, and is a fitting piece that can be fitted to any of the engagement parts 20 and 21. That is, by being fitted to the optional engagement parts 20 and 21 arranged in parallel in the extending direction Y, the mounting member 31*a* can be supplied with power, and can be fixed to the support member 2 at a plurality of places in the extending direction Y.

The first attaching side engagement part 60 is not particularly limited, as long as it functions as a connector with the support member 2 and can be engaged with part of the support member 2. In the present embodiment, the first attaching side engagement part 60 is a projecting male terminal, and, for example, a USB plug or the like can be employed.

As shown in FIG. 4, the second attaching side engagement part 61 includes an insertion port 65 into which the insertion part 53 of the panel side engagement part 51 can be inserted.

The second attaching side engagement part 61 and the panel side engagement part 51 constitute a push-in/push-out structure, and the panel side engagement part 51 is attachable and detachable. That is, in the lighting device 1, when the insertion part 53 of the panel side engagement part 51 is inserted into the insertion port 65 of the second attaching side engagement part 61 and pushed, the insertion part 53 and the insertion port 65 are engaged and attached, and the panel side engagement part 51 and the second attaching side engagement part 61 are integrated. On the other hand, in the lighting device 1, when the insertion part 53 is pushed again in an insertion direction to the insertion port 65 in a state where the panel side engagement part 51 is attached to the second attaching side engagement part 61, the engagement of the insertion part 53 and the insertion port 65 is released, and the panel side engagement part 51 can be removed from the second attaching side engagement part 61.

The connecting unit 62 is provided with a first connecting unit 70, a second connecting unit 71, and a joint part 73 as shown in FIG. 3.

The connecting units 70 and 71 are rod-like shaft portions having certain rigidity, and, in principle, are not elastically deformed. As shown in FIG. 5A, the first connecting unit 70 is bent in a middle portion and extends in an "L" shape, and is configured with a support side connecting unit 74 and a joint side connecting unit 75. The second connecting unit 71 extends in a straight line.

The joint part 73 is a connecting part which rotatably connects the first connecting unit 70 and the second connecting unit 71, and, specifically, is a universal joint. That is, the joint part 73 can freely change an angle at which the joint side connecting unit 75 of the first connecting unit 70 that is rotatable and has two shafts and the second connecting unit 71 intersect.

The lighting panels 3*b* and 3*c* are different from the lighting panel 3*a* (second lighting panel) in the structure of the mounting members 31*b* and 31*c*, and, as shown in FIG. 3, include the first attaching side engagement part 60, the second attaching side engagement part 61, and a connecting unit 80.

The connecting unit 80 is a linear portion connecting the first attaching side engagement part 60 and the second attaching side engagement part 61, and has flexibility and bendable. A length in a vertical direction (length in a longitudinal direction) of the connecting unit 80 is longer than a length in the vertical direction of the connecting unit 62 (the total length of the joint side connecting unit 75 of the first connecting unit 70 and the second connecting unit 71).

The connecting member 5 is a flexible sheet-like body made from transparent resin, and, as shown in FIGS. 3 and 4, includes a light-emitting side cover 90, side face side covers 91 and 92, and rear face side covers 93 and 94.

The light-emitting side cover 90 is a portion covering the emission surface 55 side of a plurality of the planar light-emitting panels 30, has a width similar to that of the planar light-emitting panel 30, and extends in a band shape in the same direction as the support member 2. The light-emitting side cover 90 is transparent and can transmit light emitted from the emission surface 55.

The side face side covers 91 and 92 are portions bent from an end in a width direction X (direction orthogonal to the parallel arrangement direction Y of the lighting panels 3) of the light-emitting side cover 90.

The rear face side covers 93 and 94 are portions that are folded back from an end in a bending direction of the side face side covers 91 and 92, and are falling prevention pieces that prevent the planar light-emitting panel 30 from falling off.

As shown in FIG. 2, the connecting member 5 covers both ends in the width direction X of the lighting panels 3*a* to 3*c* and does not cover both ends in the parallel arrangement direction Y. That is, the lighting panels 3*a* to 3*c* are movable in the parallel arrangement direction Y (the extending direction of the support member 2).

Then, an assembly procedure of the lighting device 1 will be described with a positional relationship of each member of the lighting device 1.

First, the planar light-emitting panel 30*a* (second planar light-emitting panels) and the planar light-emitting panels 30*b* and 30*c* are arranged in a straight line, and the connecting member 5 is attached to the planar light-emitting panels 30*a* to 30*c*.

Figure 8:
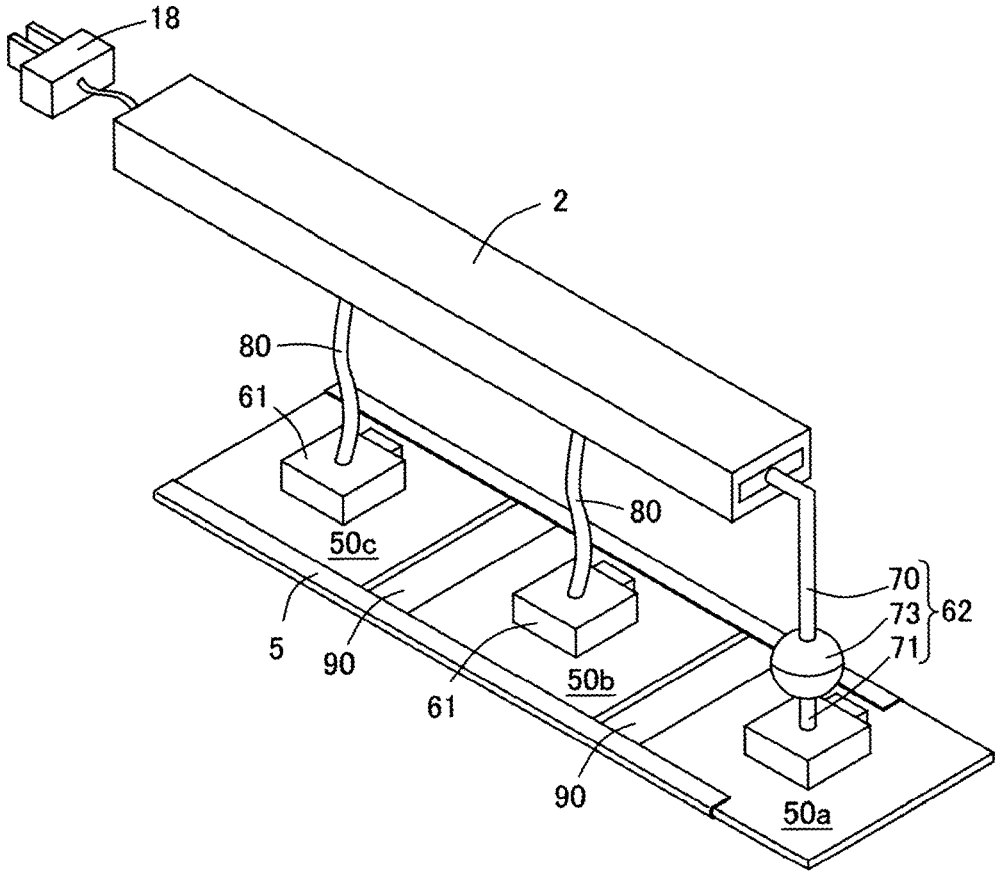
FIG. 8 is a perspective view of the lighting panel in a case where a distance between the planar light-emitting panels of the lighting device of FIG. 2 is increased.

At this time, a distance between the planar light-emitting panels 30*a* to 30*c* is optional, and may be arranged so that end faces are in contact with each other as shown in FIG. 2 or may be arranged so as to make space between the end faces as shown in FIG. 8. Further, the planar light-emitting panels 30*a* to 30*c* may be arranged at equal intervals, or may be arranged randomly. In the present embodiment, the connecting member 5 extends across the planar light-emitting panels 30*a*, 30*b*, and 30*c* adjacent in the extending direction Y of the support member 2, and the planar light-emitting panels 30*a*, 30*b*, and 30*c* are aligned in a straight line at equal intervals.

Further, in a separate process, the insertion part 53 of the panel side engagement part 51 of each of the planar light-emitting panels 30*a* to 30*c* is inserted into the insertion port 65 of the second attaching side engagement part 61 of each of the mounting members 31*a* to 31*c*. That is, the insertion part 53 is inserted into the insertion port 65 in a spreading direction of the emission surface 55 of the planar light-emitting panels 30*a* to 30*c*.

At this time, the insertion directions of the insertion parts 53 of the planar light-emitting panels 30*a* to 30*c* into the insertion ports 65 are all the same, and are all in the width directions X of the planar light-emitting panels 30*a* to 30*c* (direction orthogonal to the parallel arrangement direction Y when viewed from the front).

Further, engagement parts between the panel side engagement parts 51 of the planar light-emitting panels 30*a* to 30*c* and the second attaching side engagement parts 61 of the mounting members 31*a* to 31*c* overlap the planar light-emitting panels 30*a* to 30*c* when the emission surfaces 55 of the planar light-emitting panels 30*a* to 30*c* are viewed from the front. In the present embodiment, the mounting members 31*a* to 31*c* are hidden by the planar light-emitting panels 30*a* to 30*c* when viewed from the front.

Figure 6:
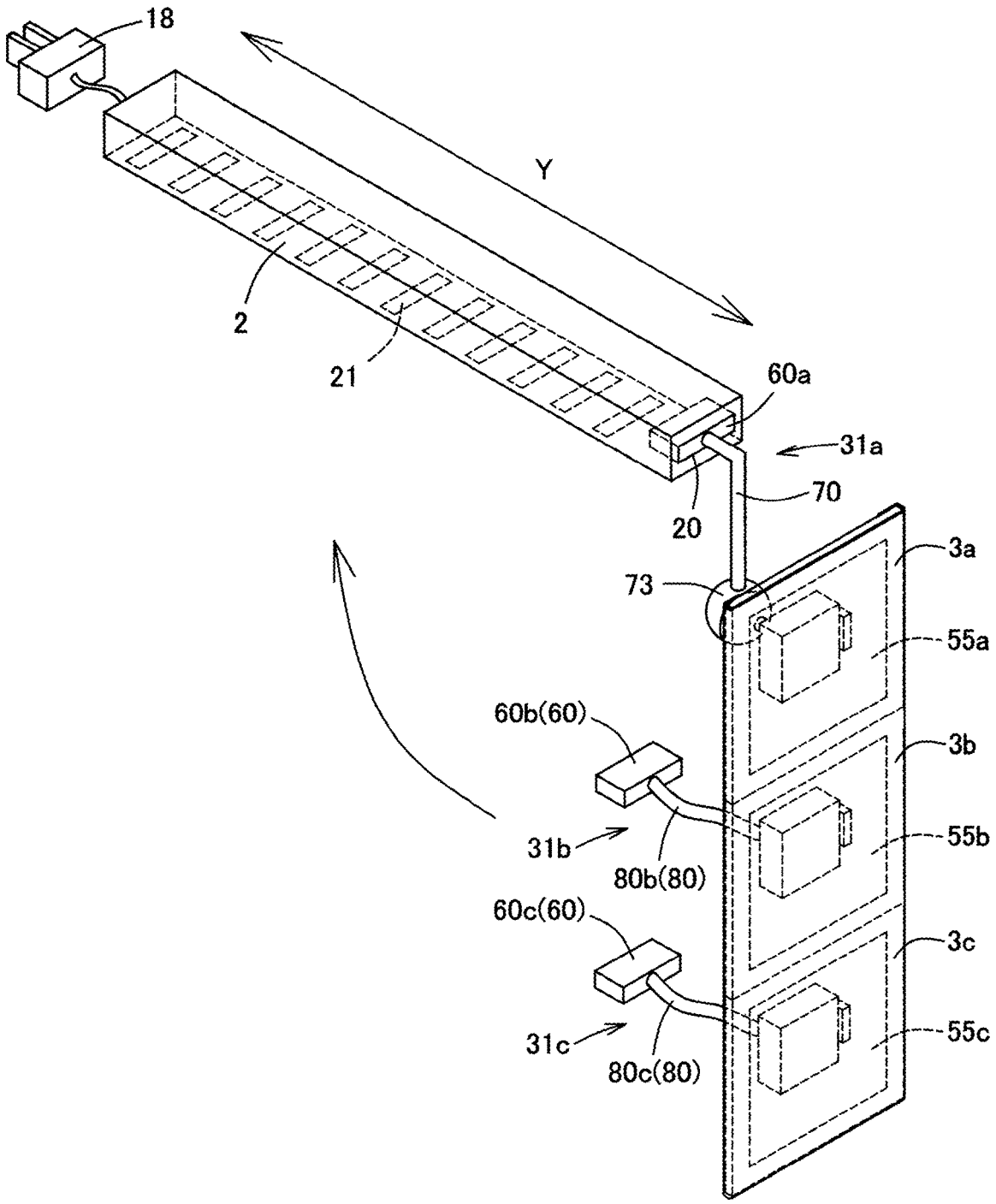
FIG. 6 is an explanatory view showing an example of an assembly process of the lighting device of FIG. 2, and a perspective view when each planar light-emitting panel in a state of being connected by a connecting member is attached to the support member.

Next, as shown in FIG. 6, the first attaching side engagement part 60*a* is inserted into the end face side engagement part 20 of the support member 2, and the lighting panels 3*a* to 3*c* are fixed to the support member 2.

Figure 7A:
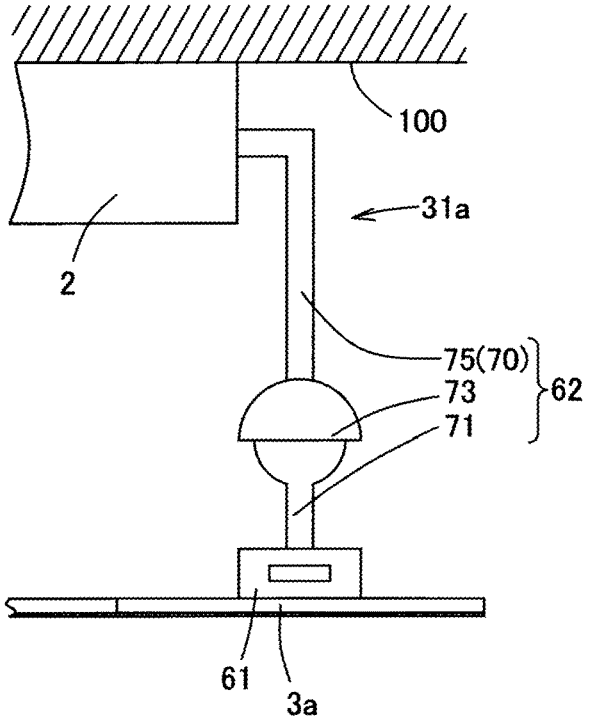
Figure 7B:
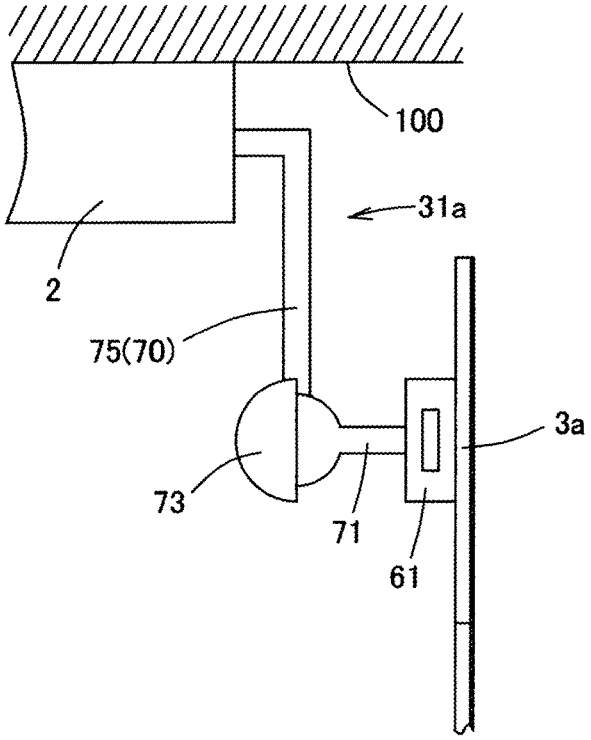

At this time, as shown in FIGS. 6 and 7B, the mounting member 31*a* takes an intersecting posture in which the second connecting unit 71 intersects the joint side connecting unit 75 of the first connecting unit 70 by the joint part 73, and the planar light-emitting panel 30*a* takes a second posture in which the emission surface 55 is oriented in the same direction as the extending direction Y. The lighting panel 3*a* is supported in a cantilever manner by the support member 2, and the lighting panels 3*b* and 3*c* are supported by the lighting panel 3*a* via the connecting member 5.

Next, a positional relationship, such as the distance between the lighting panels 3*a* to 3*c* and the like, is adjusted according to necessity, and, as shown in FIG. 7A, the posture is changed to a linear posture in which the second connecting unit 71 is arranged in the same direction as the joint side connecting unit 75 of the first connecting unit 70 by the joint part 73, and the lighting panel 3*a* is changed from the second posture to the first posture in which the emission surface 55 of the planar light-emitting panel 30*a* faces a downward direction, which is orthogonal to the extending direction Y. Then, the lighting panels 3*b* and 3*c* are rotated in a state of being supported by the lighting panel 3*a* via the connecting member 5, and the first attaching side engagement parts 60*b* and 60*c* are inserted into the side face side engagement parts 21 at optional positions of the support member 2.

At this time, the first attaching side engagement parts 60*b* and 60*c* are inserted into the corresponding side face side engagement parts 21 in an upward direction, which is a direction orthogonal to the extending direction of the support member 2, and connecting units 80*b* and 80*c* are in a state of being suspended by the support member 2.

Further, engagement parts between the first attaching side engagement parts 60*a* to 60*b* of the mounting members 31 and the engagement parts 20, 21, and 21 of the support member 2 overlap the planar light-emitting panels 30*a* to 30*c* when the emission surfaces 55 of the planar light-emitting panels 30*a* to 30*c* are viewed from the front.

Next, in the lighting device 1 of this embodiment, operation when the planar light-emitting panel 30*b* that has been used is replaced will be described.

Figure 9:
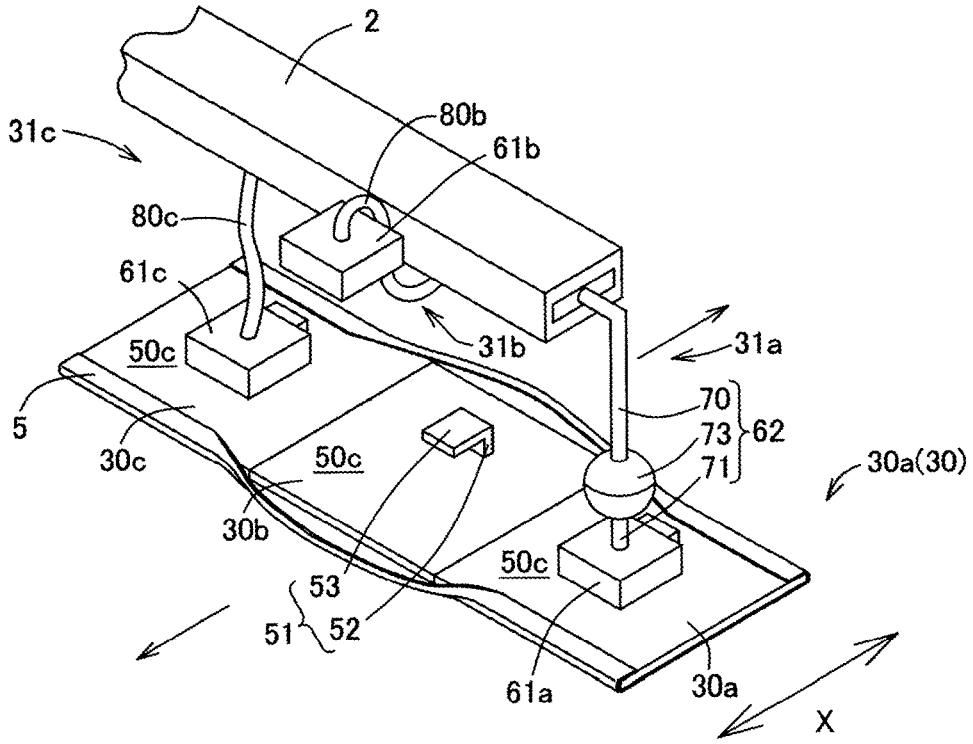
FIG. 9 is a perspective view showing a situation when the planar light-emitting panel is removed from the connecting member for replacing the lighting device of FIG. 2.

When the planar light-emitting panel 30*b* is removed, the insertion part 53 of the planar light-emitting panel 30*b* is pulled out from the insertion port 65 of the second attaching side engagement part 61*b*. That is, the insertion part 53 is pushed into the insertion port 65, the second attaching side engagement part 61*b* is slid in the width direction X which is an orthogonal direction to the support member 2, engagement between the insertion part 53 and the insertion port 65 is released, and the insertion part 53 is pulled out. Then, as shown in FIG. 9, in a state where the adjacent planar light-emitting panels 30*a* and 30*c* are supported by the support member 2, the connecting member 5 is spread in the width direction X, and the planar light-emitting panel 30*b* is removed from the connecting member 5.

Further, in a case of replacing the entire lighting panel 3*b*, the first attaching side engagement part 60*b* of the lighting panel 3*b* is moved downward so as to be pulled out from the side face side engagement part 21 of the support member 2, so that engagement between the first attaching side engagement part 60*b* and the side face side engagement part 21 is released. Then, the connecting member 5 is spread in the width direction X, and the lighting panel 3*b* is removed from the connecting member 5.

According to the lighting device 1 of the present embodiment, since an end of the connecting member 5 is open, the planar light-emitting panel 30 can be moved in the extending direction Y of the connecting member 5 in a state of being attached to the connecting member 5, and the planar light-emitting panel 30 can be disposed at a desired position in the extending direction of the support member 2.

According to the lighting device 1 of the present embodiment, since the first attaching side engagement part 60 can be inserted into and fixed to any of the side face side engagement parts 21A to 21L, the lighting panel 3 can be installed at a desired position by inserting the first attaching side engagement part 60 into the side face side engagement part 21 that matches with a desired arrangement position.

According to the lighting device 1 of the present embodiment, an insertion direction of the first attaching side engagement part 60 into the side face side engagement part 21 is orthogonal to the extending direction of the support member 2, and, furthermore, an insertion direction of the insertion part 53 into the insertion port 65 on a projection plane in a thickness direction of the planar light-emitting panel 30 is also orthogonal to the extending direction of the support member 2. For this reason, when the first attaching side engagement part 60 is inserted into the side face side engagement part 21, and the insertion part 53 is inserted into the insertion port 65, it is not buffered by the other lighting panel 3 arranged in parallel in the extending direction, and attaching and detaching work is facilitated. Further, since the mounting member 31 is hidden by the planar light-emitting panel 30 when viewed from the front, the mounting member 31 is difficult to visually recognize from the user side, and the appearance is better than that in the prior art.

According to the lighting device 1 of the present embodiment, the connecting member 5 has flexibility. Accordingly, as shown in FIG. 9, by spreading the connecting member 5 outward to form space between the connecting member 5 and the planar light-emitting panel 30, the planar light-emitting panel 30 can be removed from the space while being supported by the support member 2.

According to the lighting device 1 of the present embodiment, since a large part of the feeding wiring line 25 is covered by the forming portions 10 to 15 of the support member 2, the user can be prevented from directly touching the feeding wiring line 25.

According to the lighting device 1 of the present embodiment, the emission surface 55 of each of the lighting panels 3*a* to 3*c* has height adjusted by the connecting member 5, and can be visually recognized through the light-emitting side cover 90 of the connecting member 5. For this reason, the lighting device 1 can be recognized by the user as a series of one illumination.

According to the lighting device 1 of the present embodiment, the planar light-emitting panels 30*a* to 30*c* used for the lighting panels 3*a* to 3*c* are the same type. For this reason, the yield is improved as compared with a case where different types of the planar light-emitting panels 30 are used individually, and the lighting device 1 can be manufactured at a lower cost as compared with the prior art. Note that, the lighting device 1 may use different types of the planar light-emitting panels 30 individually when needed.

According to the lighting device 1 of the present embodiment, the support member 2 is provided with a plurality of the side face side engagement parts 21, and, by changing the side face side engagement part 21 to be engaged with the first attaching side engagement part 60, the position of the lighting panel 3 relative to the support member 2 can be adjusted. For this reason, position adjustment of the lighting panel 3 is easy.

Next, a lighting device 200 of a second embodiment of the present invention will be described.

Figure 10:
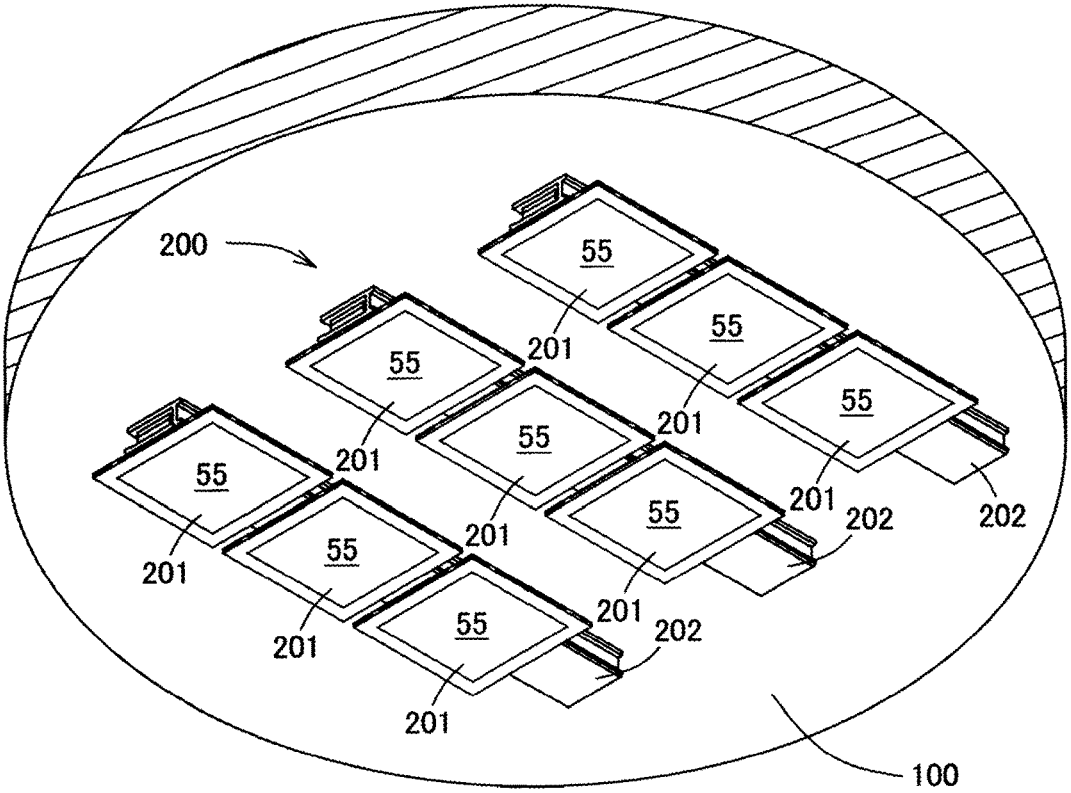
FIG. 10 is a perspective view schematically showing an installation situation of a lighting device of a second embodiment of the present invention.
Figure 11:
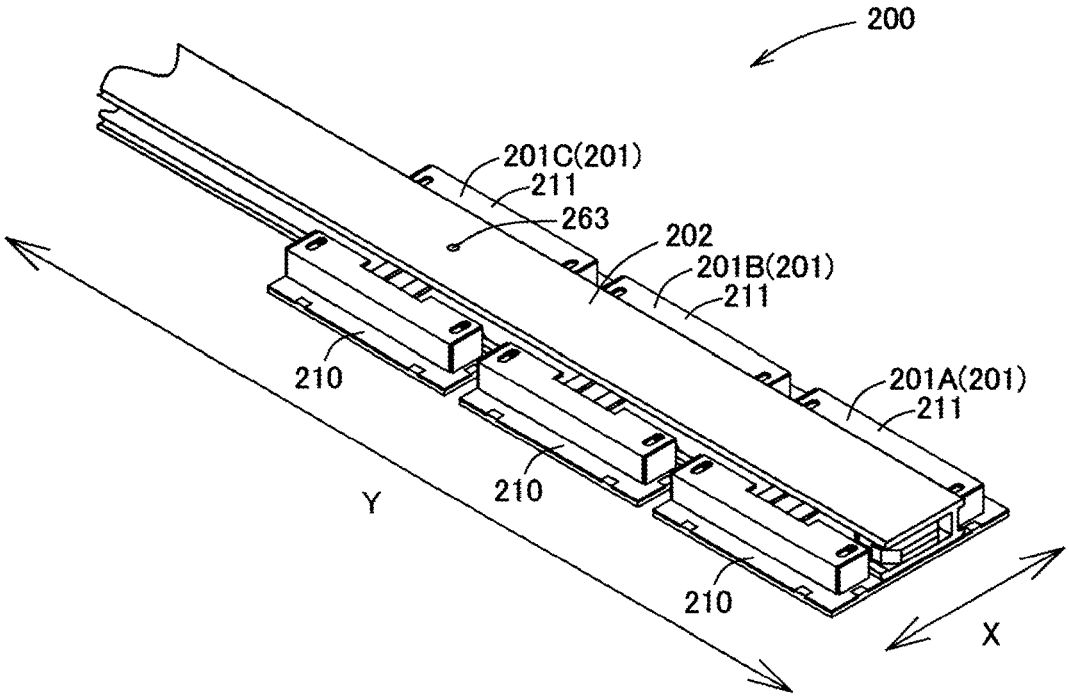
FIG. 11 is a perspective view of the lighting device of FIG. 10 as viewed from a rear surface side.
Figure 12:
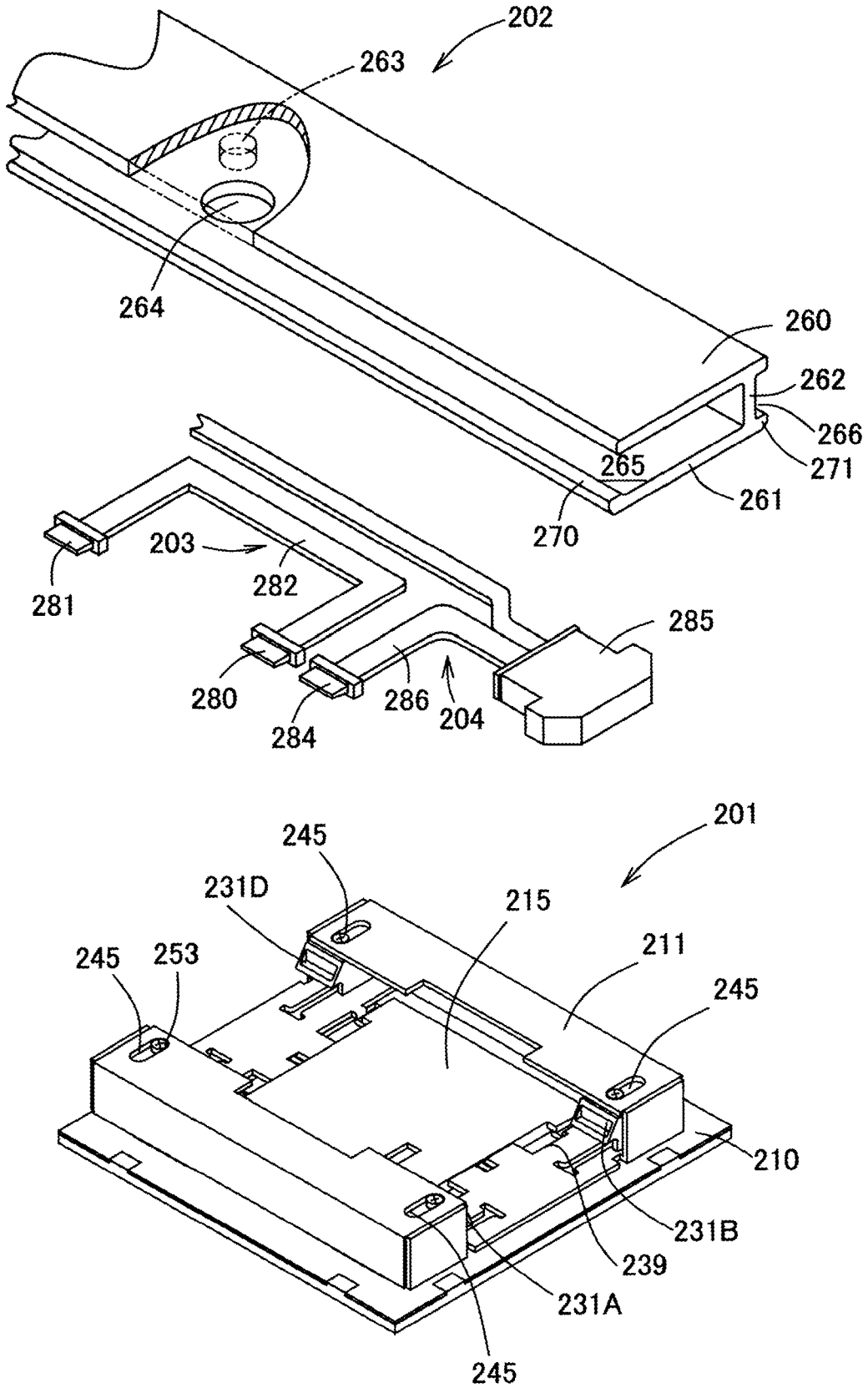
FIG. 12 is an exploded perspective view of the lighting device of FIG. 11.

As shown in FIGS. 10 to 12, the lighting device 200 according to the second embodiment of the present invention includes a lighting panel 201, a rail member 202 (support member), a first wiring member 203 (feeding wiring line), and a second wiring member 204 (feeding wiring line).

Figure 13:
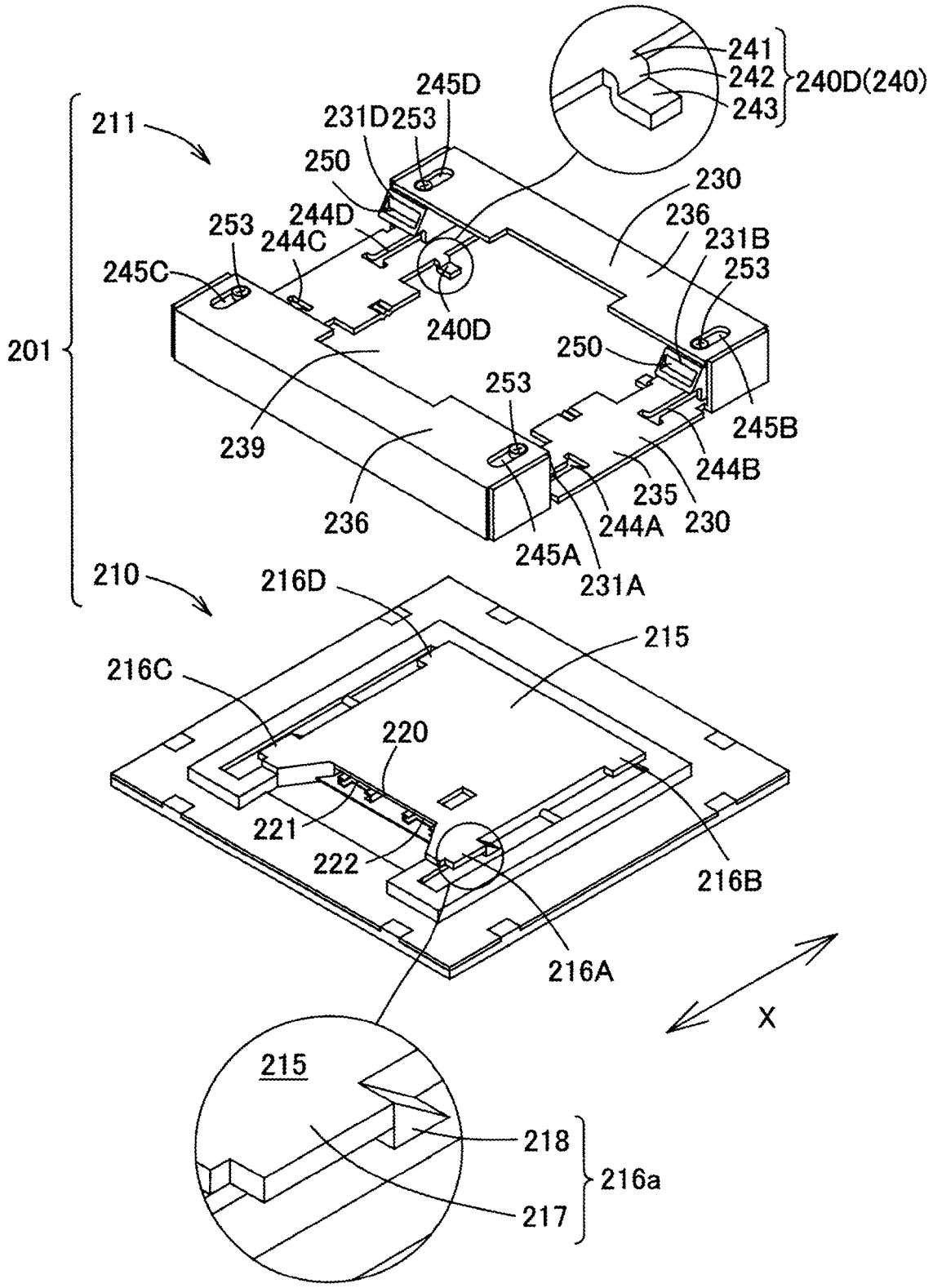
FIG. 13 is an exploded perspective view of a lighting panel of FIG. 12.

The lighting panel 201 is equipped with a planar light-emitting panel 210 and a mounting member 211 as shown in FIG. 13.

The planar light-emitting panel 210 is an organic EL panel having the emission surface 55 on the front, and has a raised portion 215 on the rear. The raised portion 215 is a projecting portion raised in a thickness direction of the planar light-emitting panel 210 with respect to the other rear surface portion, and is a protection portion for storing and protecting a constant current element 223 and a control switching portion 224 shown in FIG. 17A. As shown in FIG. 13, the raised portion 215 has a rectangular shape in a rear view, and has panel side engagement parts 216A and 216B and panel side engagement parts 216C and 216D provided on two opposing sides.

The panel side engagement parts 216A to 216D are overhanging pieces projecting outward from an end of the raised portion 215 in a spreading direction of the emission surface 55 (hereinafter, also simply referred to as a plane direction), and, as shown in FIG. 13, configured with a first engagement part 217 which constitutes the same flat and flush surface with the raised portion 215, and a second engagement part 218 which extends from part of the first engagement part 217 in a direction orthogonal to the first engagement part 217.

The first engagement parts 217 of the panel side engagement parts 216A to 216D are restricting parts that restrict movement of the planar light-emitting panel 210 in a direction orthogonal to the emission surface 55 (overlapping direction with the mounting member 211) by being engaged with holder side engagement parts 240A to 240D of the mounting member 211. On the other hand, the second engagement parts 218 of the panel side engagement parts 216A to 216D are restricting parts that restrict movement of the mounting member 211 in the spreading direction (slide movement direction) of the emission surfaces 55 by being engaged with the holder side engagement parts 240A to 240D of the mounting member 211.

The panel side engagement parts 216A and 216B are provided on one of two sides facing in the extending direction Y of the rail member 202, and are arranged at predetermined intervals along the one side. The panel side engagement parts 216C and 216D are provided on the other side, and are arranged along the other side at predetermined intervals.

As shown in FIG. 13, the raised portion 215 has a notch 220 that is partially notched when viewed from the rear, and a first connector portion 221 and a second connector portion 222 are provided in the notch 220.

The connector portions 221 and 222 are power supply connectors that can be connected to wiring side connector portions 280, 281, and 284 of the wiring members 203 and 204. The connector portions 221 and 222 are specifically female connectors, and their insertion directions substantially coincide with the plane direction.

Figure 17A:
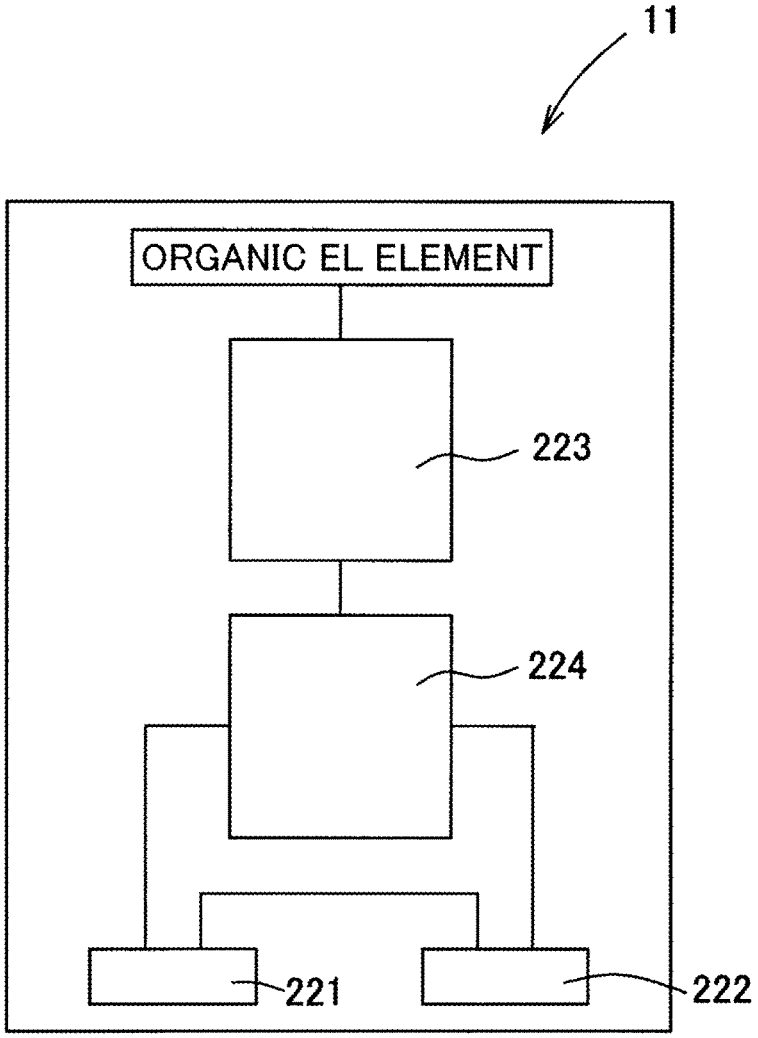

The connector portions 221 and 222 are electrically connected to an organic EL element via the constant current element 223 and the control switching portion 224 which are disposed in the raised portion 215 as shown in FIG. 17A, and are further electrically connected by a conductive path separately without passing through the organic EL element.

The constant current element 223 is an element capable of supplying a constant current to the organic EL element, and the control switching portion 224 is a portion that switches a plurality of types of control, such as dimming control and toning control, by PWM control or the like.

Figure 15:
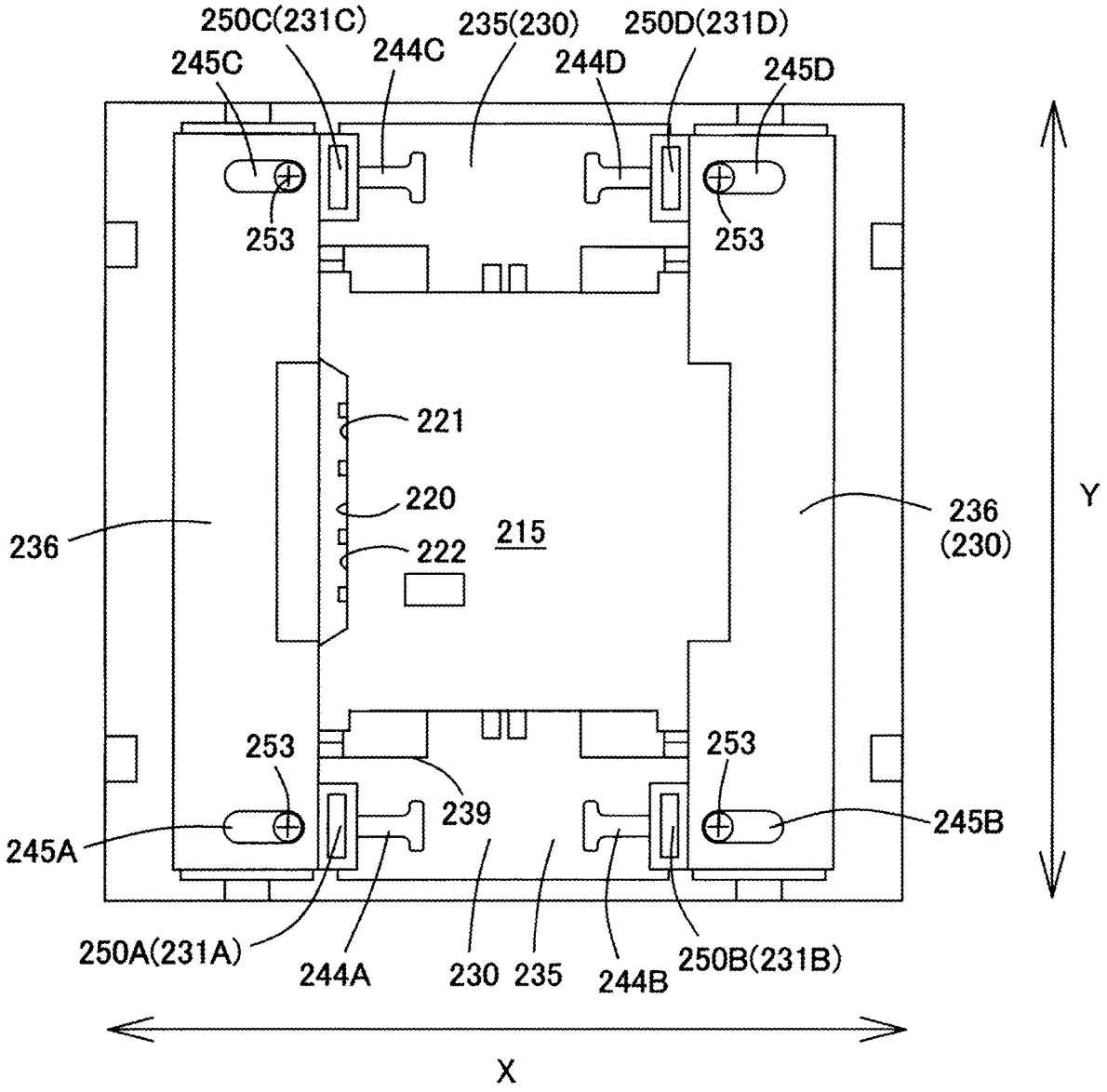
FIG. 15 is a rear view of the lighting panel of FIG. 12.

The mounting member 211 includes a holder member 230 and engagement units 231A to 231D as shown in FIGS. 13 and 15.

Figure 14:
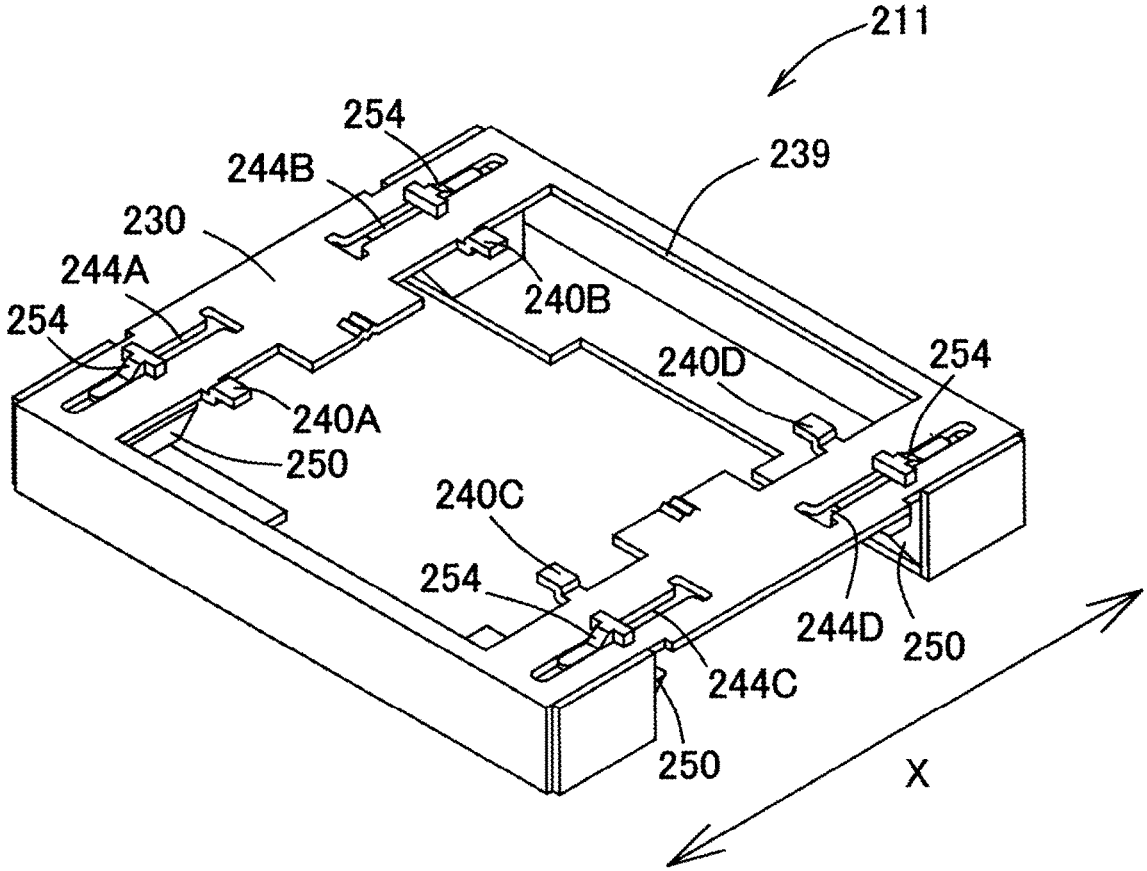
FIG. 14 is a perspective view of a mounting member of FIG. 13 as viewed from another direction.

The holder member 230 includes a holder main body 235 and a holder accommodating portion 236 as shown in FIGS. 13 and 14. The holder main body 235 has a holder side opening 239, and includes the holder side engagement parts 240A to 240D and first restriction grooves 244A to 244D along an opening edge of the holder side opening 239.

The holder side engagement parts 240A to 240D are engaging pieces engageable with the panel side engagement part 216, and, as shown in FIG. 13, include an extending portion 241 that extends from the holder side opening 239, a vertical wall portion 242 bent from an end of the extending portion 241, and a locking portion 243 further bent from an end of the vertical wall portion 242.

The first restriction grooves 244A to 244D are grooves for restricting a moving direction of the engagement unit 231, and are substantially "T"-shaped grooves when viewed from the front as shown in FIG. 14. The first restriction grooves 244A to 244D are grooves for locking disengagement of an engaging member 250 from a restricting piece 254, and there exist a portion where the restricting piece 254 can be inserted and removed and a portion where the restricting piece 254 cannot be inserted or removed in an extending direction, and the first restriction grooves 244A to 244D extend in the width direction X as a whole.

The holder accommodating portion 236 is a casing opened toward the center as shown in FIG. 13 and can accommodate part or all of the engagement unit 231. In the holder accommodating portion 236, second restriction grooves 245A to 245D are formed on a wall surface on the rear side of the holder accommodating portion.

Figure 16:
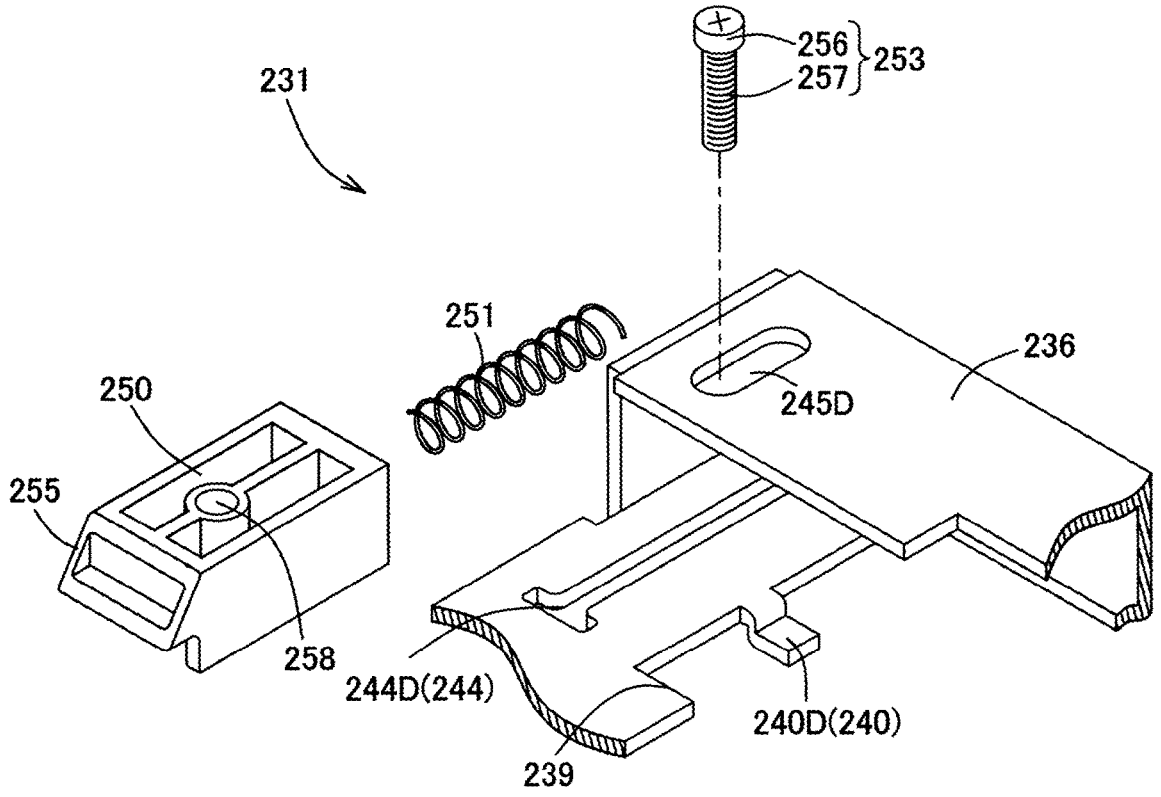
FIG. 16 is an exploded perspective view of a main part of the lighting panel of FIG. 12.

The second restriction grooves 245A to 245D are grooves that extend in the width direction X and restrict the moving direction of the engagement unit 231 in the width direction X. As shown in FIG. 16, the second restriction grooves 245A to 245D are grooves into which a shaft portion 257 of a fixing member 253 can be inserted, and to which a head part 256 of the fixing member 253 is fitted.

The engagement unit 231 includes the engaging member 250, an urging member 251, and the fixing member 253 as shown in FIG. 16.

The engaging member 250 is a fall preventing member which is engaged with the rail member 202 to prevent the lighting panel 201 from falling, and, as shown in FIGS. 14 and 16, includes the restricting piece 254, a locking portion 255, and a fixed portion 258. The restricting piece 254 is a locking piece that restricts the moving direction of the engaging member 250 in one direction by moving along the first restriction grooves 244A to 244D. The locking portion 255 is an inclined portion which is inclined in a direction intersecting with the insertion direction of the rail member 202. The fixed portion 258 is a portion that can be engaged with the fixing member 253, and, specifically, is a fastening hole that can be fastened with the shaft portion 257 of the fixing member 253.

The urging member 251 is a member that has elasticity and is elastically deformed, so as to urge the engaging member 250 in a predetermined direction, and is specifically a coil spring. The urging member 251 is located between the holder accommodating portion 236 and the engaging member 250, and urges the engaging member 250 in a direction away from the holder accommodating portion 236.

The fixing member 253 has the head part 256 and the shaft portion 257.

The fixing member 253 is a member that becomes flush with the engaging member 250 when the head part 256 is fitted in the second restriction groove 245, and fixes the engaging member 250 in the holder accommodating portion 236 when the shaft portion 257 passes through the second restriction groove 245 and is engaged with the fixed portion 258 of the engagement unit 231.

Figure 18:
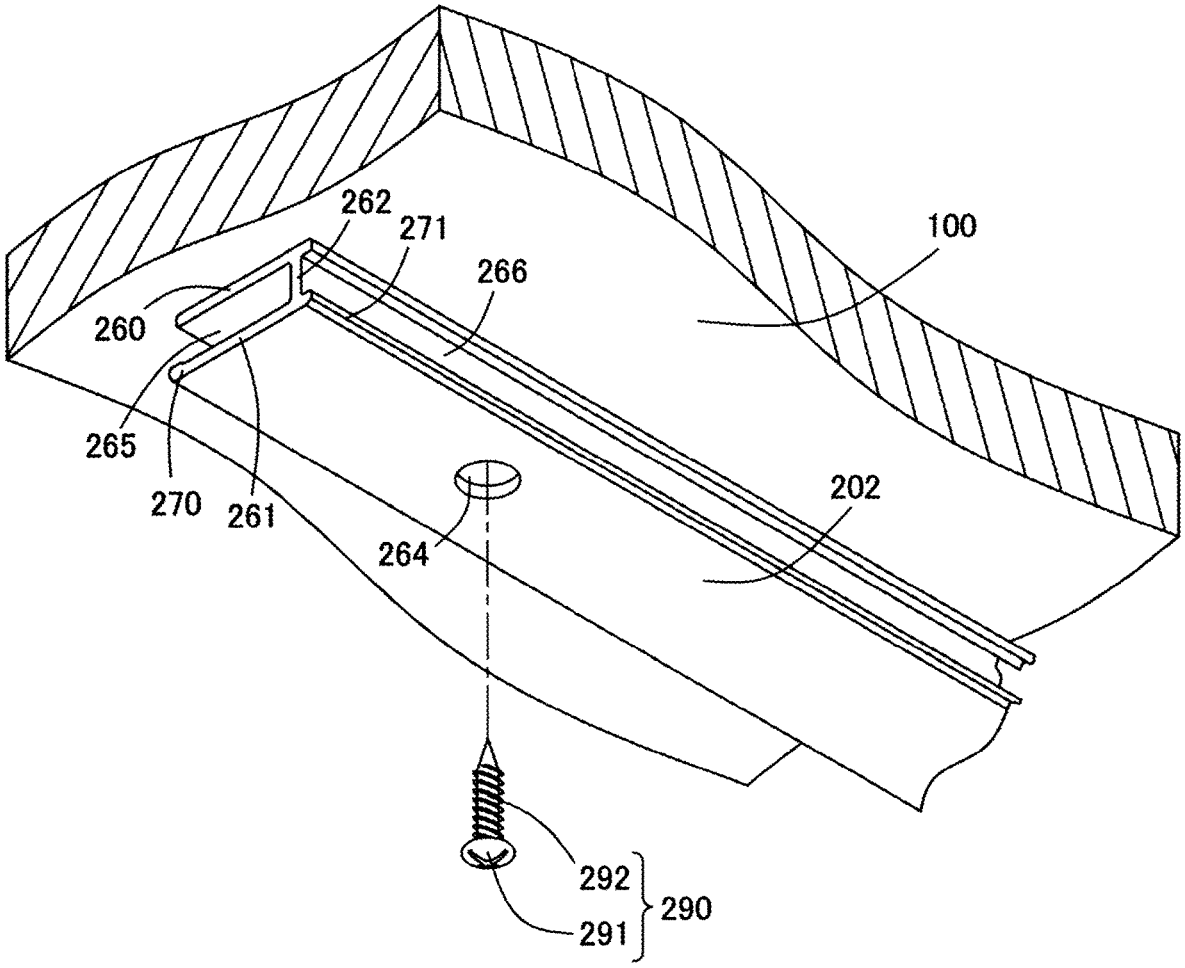
FIG. 18 is a perspective view showing a situation when a rail member is attached to a mounting surface.

The rail member 202 is fixed to the mounting surface 100 by a fastening element 290 having a head part 291 and a shaft portion 292 as shown in FIG. 18. The rail member 202 is an elongated body having a substantially "H"-shaped cross section as shown in FIG. 12, and has an outline shape which is preferably a flat shape having a ratio of width to height of 2 or more and 8 or less.

The rail member 202 includes a first wall portion 260 and a second wall portion 261 facing each other with space between them, and a connecting wall portion 262 that connects middle portions of the wall portions 260 and 261.

Fixing holes 263 and 264 having different sizes are formed on the first wall portion 260 and the second wall portion 261, and the fixing hole 263 of the first wall portion 260 has an opening that is smaller than the fixing hole 264 of the second wall portion 261. The fixing hole 263 of the first wall portion 260 has an opening diameter smaller than an outer diameter of the head part 291 of the fastening element 290 and has an opening diameter larger than an outer diameter of the shaft portion 292. The fixing hole 264 of the second wall portion 261 has an opening diameter larger than the outer diameters of the head part 291 and the shaft portion 292 of the fastening element 290.

The connecting wall portion 262 is a wall portion that is provided in the vicinity of one end of the wall portions 260 and 261, and divides space between the wall portions 260 and 261 into two. That is, the space between the first wall portion 260 and the second wall portion 261 is divided into wiring space 265 in which the wiring members 203 and 204 can be accommodated, and other space 266. Both ends in the width direction X of the second wall portion 261 which is an overhanging portion from the connecting wall portion 262 can be engaged with the engagement unit 231 of the mounting member 211, and constitute rail side engagement parts 270 and 271.

As shown in FIG. 12, the first wiring member 203 is provided with the wiring side connector portions 280 and 281, and a wiring portion 282 that connects the wiring side connector portions 280 and 281.

On the other hand, the second wiring member 204 includes the wiring side connector portion 284 connectable to the connector portions 221 and 222 of the lighting panel 201, an inter-device connection connector portion 285 connectable to the wiring member 204 of another lighting device or an external power source, and a wiring portion 286 that connects the connector portions 284 and 285.

The wiring side connector portions 280, 281, and 284 are power supply connectors for supplying power to the connector portions 221 and 222 (see FIG. 13) of the lighting panel 201, and are, specifically, male connectors. The wiring portions 282 and 286 are flexible cord-like portions and bendable.

Next, a positional relationship of each member will be described together with an assembly procedure of the lighting device 200.

First, as shown in FIG. 18, the fastening element 290 is inserted from an outer side of the fixing hole 264 of the second wall portion 261 and inserted into the fixing hole 263 of the first wall portion 260 to attach the rail member 202 to the mounting surface 100.

At this time, in the fastening element 290, the shaft portion 292 is inserted into the fixing hole 263, and the head part 291 is positioned in the wiring space 265 between the first wall portion 260 and the second wall portion 261.

The planar light-emitting panel 210 is inserted into the holder side opening 239 of the mounting member 211, and, in this state, is slid in the width direction X orthogonal to the rail member 202 so as to be attached to the mounting member 211.

At this time, the holder side engagement part 240 of the mounting member 211 is engaged with the panel side engagement part 216 of the planar light-emitting panel 210, and movement of the planar light-emitting panel 210 relative to the mounting member 211 in the sliding direction and overlapping direction is restricted.

Next, the wiring side connector portion 280 of the first wiring member 203 is inserted into the first connector portion 221.

At this time, the other connector portion 281 of the first wiring member 203 is a free end, and is supported by the first connector portion 221 in a cantilevered manner.

Next, the wiring members 203 and 204 are pushed into the wiring space 265 of the rail member 202, and the engagement unit 231 of the lighting panel 201 is engaged with the rail side engagement parts 270 and 271 of the rail member 202.

Figure 19A:
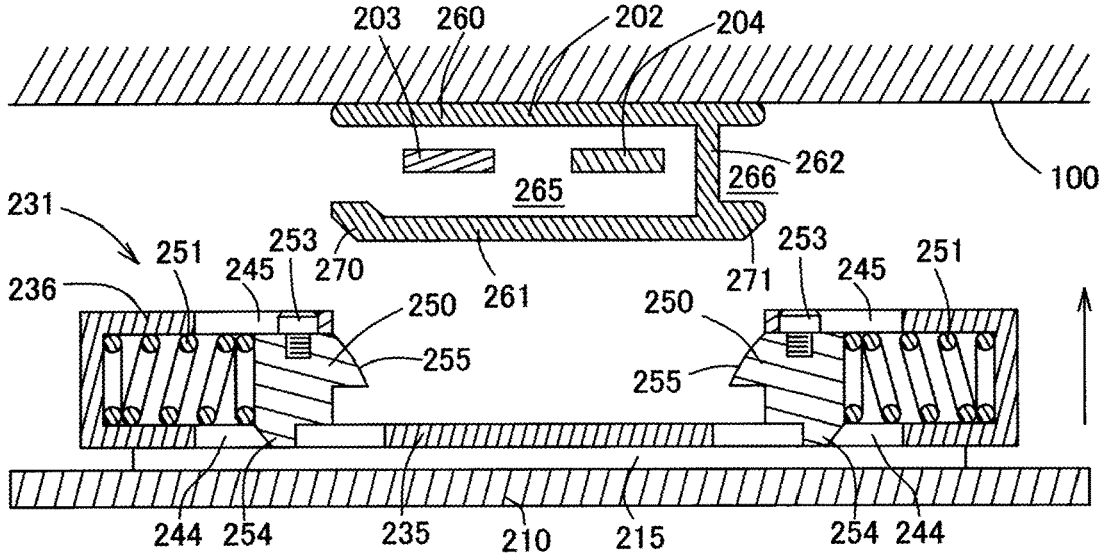
Figure 19B:
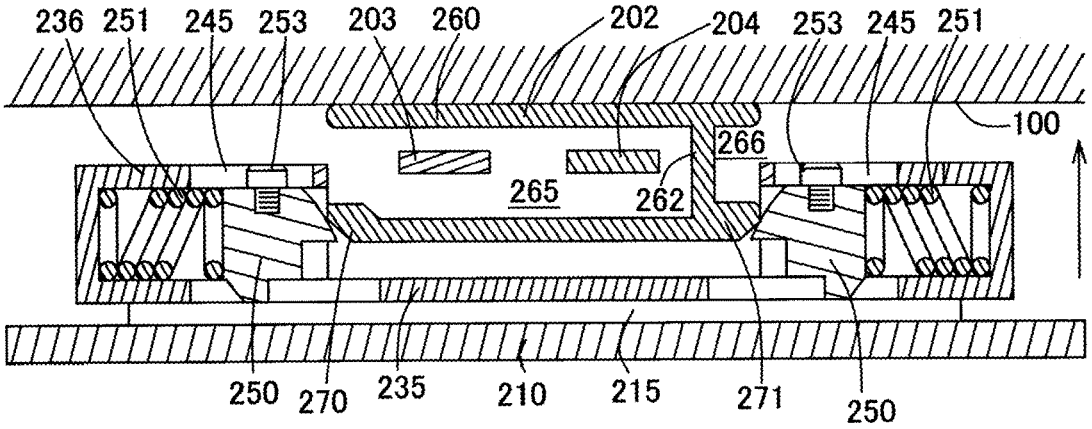
Figure 19C:
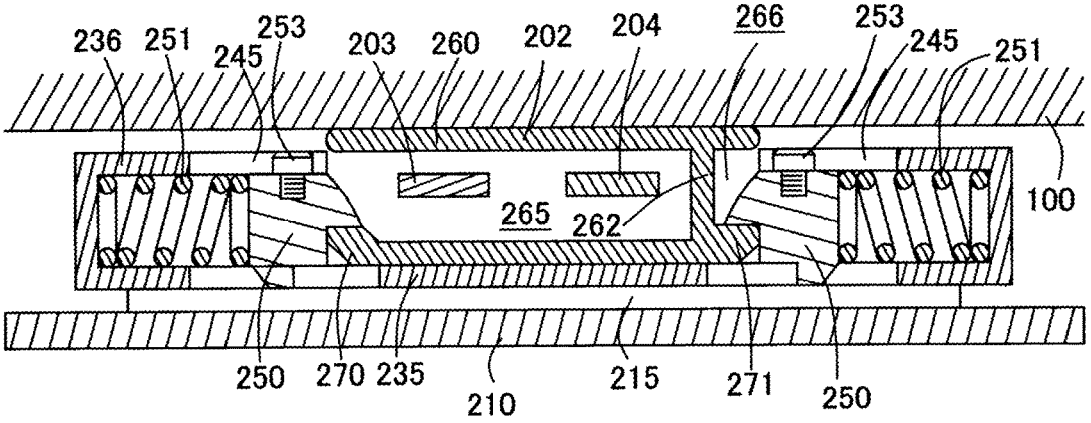

At this time, as shown in FIGS. 19A, 19B, and 19C, the rail side engagement parts 270 and 271 abut on the inclined locking portion 255 of the engaging member 250 of the engagement unit 231 and are engaged while expanding the engaging member 250. That is, the rail side engagement parts 270 and 271 move the engaging members 250 away from each other against an urging force of the urging member 251, and, when the rail side engagement parts 270 and 271 move beyond the locking portion 255, an urging force of the urging member 251 moves the engaging members 250 of the engagement unit 231 in the direction of approaching each other. The rail side engagement parts 270 and 271 and the engaging member 250 engage in the overlapping direction (the direction orthogonal to the extending direction Y).

Further, in a state where the engagement unit 231 is engaged with the rail side engagement parts 270 and 271, the insertion direction of the wiring side connector portions 280, 281 and 284 of the wiring members 203 and 204 into the first connector portion 221 or the second connector portion 222 is orthogonal to the extending direction Y of the rail member 202.

Figure 17B:
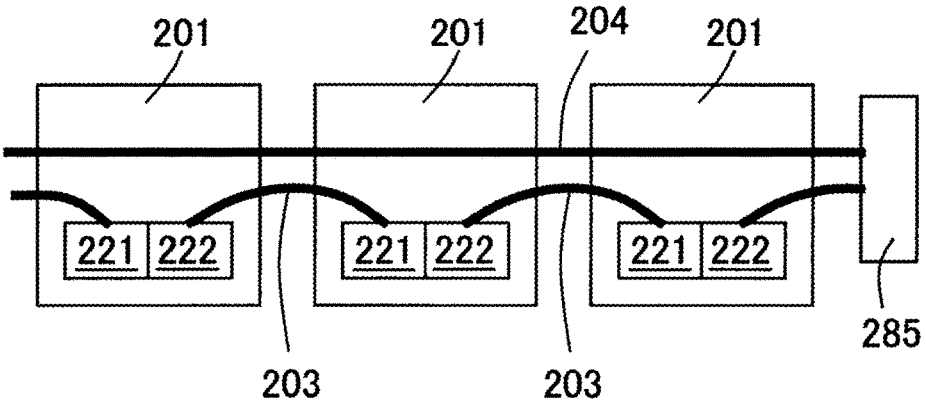

Furthermore, as shown in FIGS. 17A and 17B, in the lighting panel 201, the connector portion 221 is electrically connected in series to the connector portion 222 of another lighting panel 201 adjacent in the extending direction Y of the rail member 202 via the first wiring member 203.

When the planar light-emitting panel 210 is removed from the rail member 202, the planar light-emitting panel 210 is slid in the width direction X orthogonal to the rail member 202, and the planar light-emitting panel 210 is moved to one side in the width direction X. By doing this, the engagement between the panel side engagement parts 216A to 216D of the planar light-emitting panel 210 and the holder side engagement parts 240A to 240D of the mounting member 211 is released, and the planar light-emitting panel 210 is removed from the mounting member 211.

Further, in a case of replacing the entire lighting panel 201, the mounting member 211 of the lighting panel 201 is moved to one side in the width direction X, and the head part 256 of the fixing member 253 is operated in this state to remove the lighting panel 201 from the rail member 202. Alternatively, the mounting member 211 of the lighting panel 201 is slid along the longitudinal direction Y of the rail member 202, and the lighting panel 201 is removed from the end of the rail member 202.

According to the lighting device 200 of the present embodiment, the respective lighting panels 201 are electrically connected in series, the emission surfaces 55 of the planar light-emitting panels 210 can be evenly lit.

According to the lighting device 200 of the present embodiment, since the wiring members 203 and 204 are hidden by the rail member 202, the appearance is better than that in the prior art, and disconnection due to external factors, such as contact, does not easily occur.

Next, a lighting device 300 of a third embodiment will be described.

Figure 20:
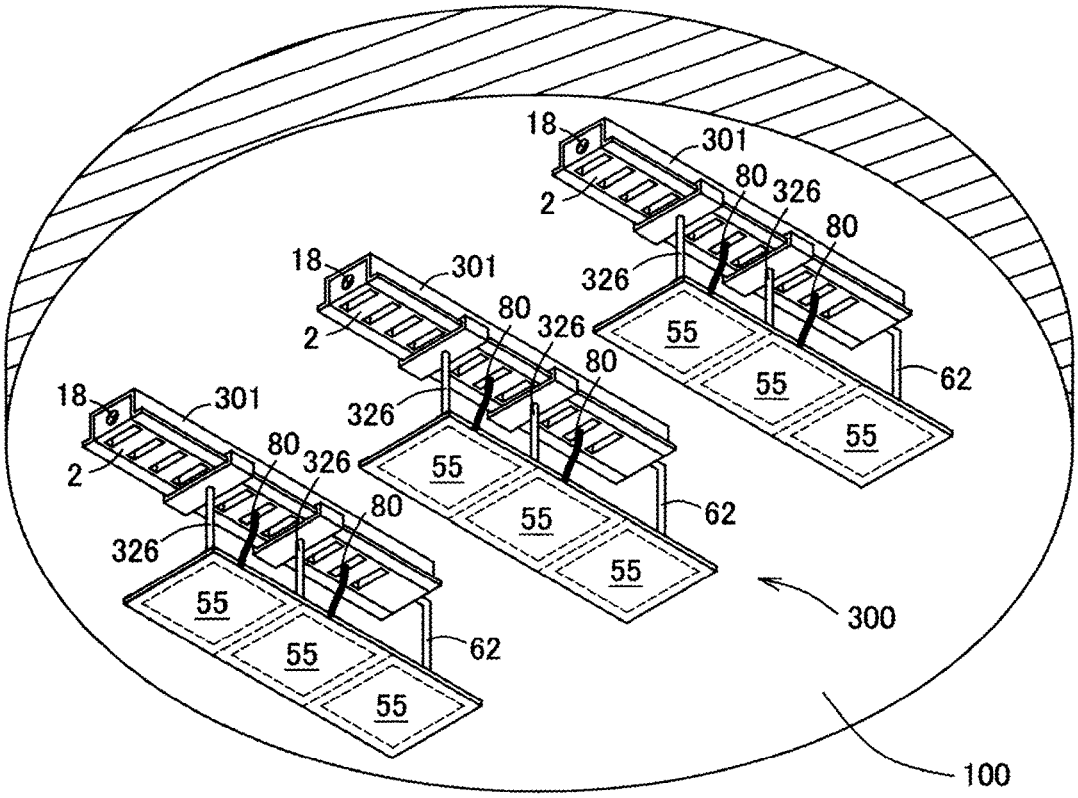
FIG. 20 is a perspective view schematically showing an installation situation of the lighting device of a third embodiment of the present invention.
Figure 21:
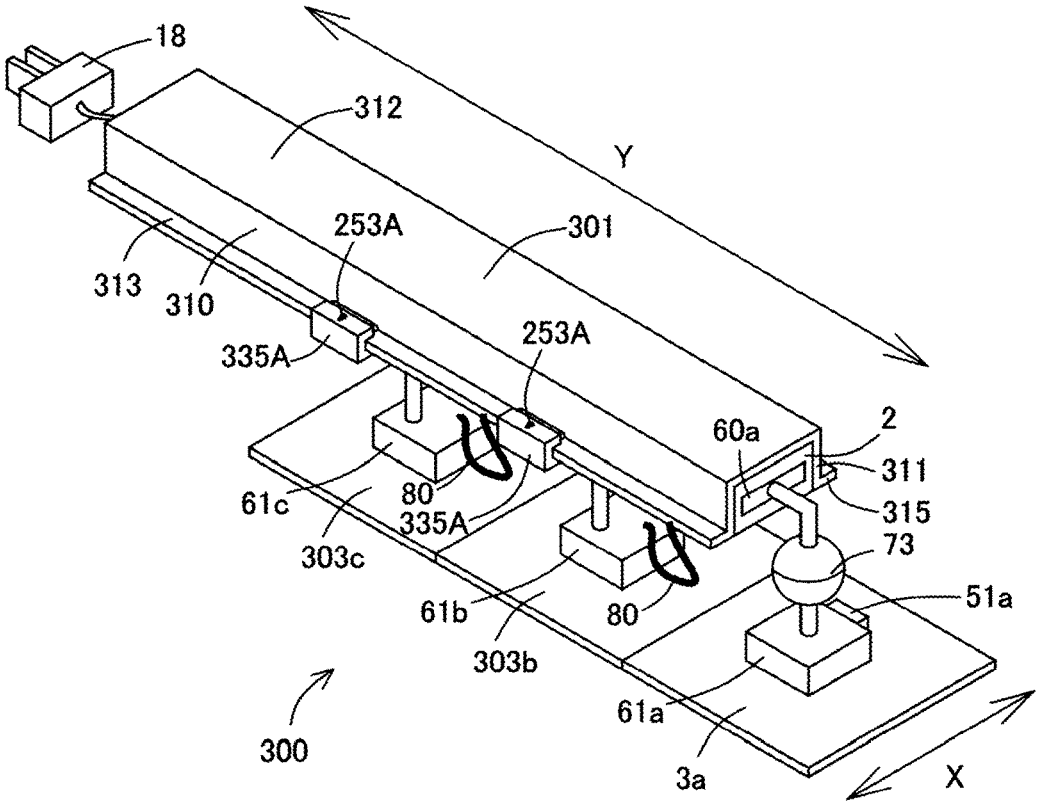
FIG. 21 is a perspective view of the lighting device of FIG. 20 as viewed from a rear surface side.

The lighting device 300 of the third embodiment is provided with a rail member 301, the support member 2, and lighting panels 3*a*, 303*b*, and 303*c* as shown in FIGS. 20 and 21.

Figure 22:
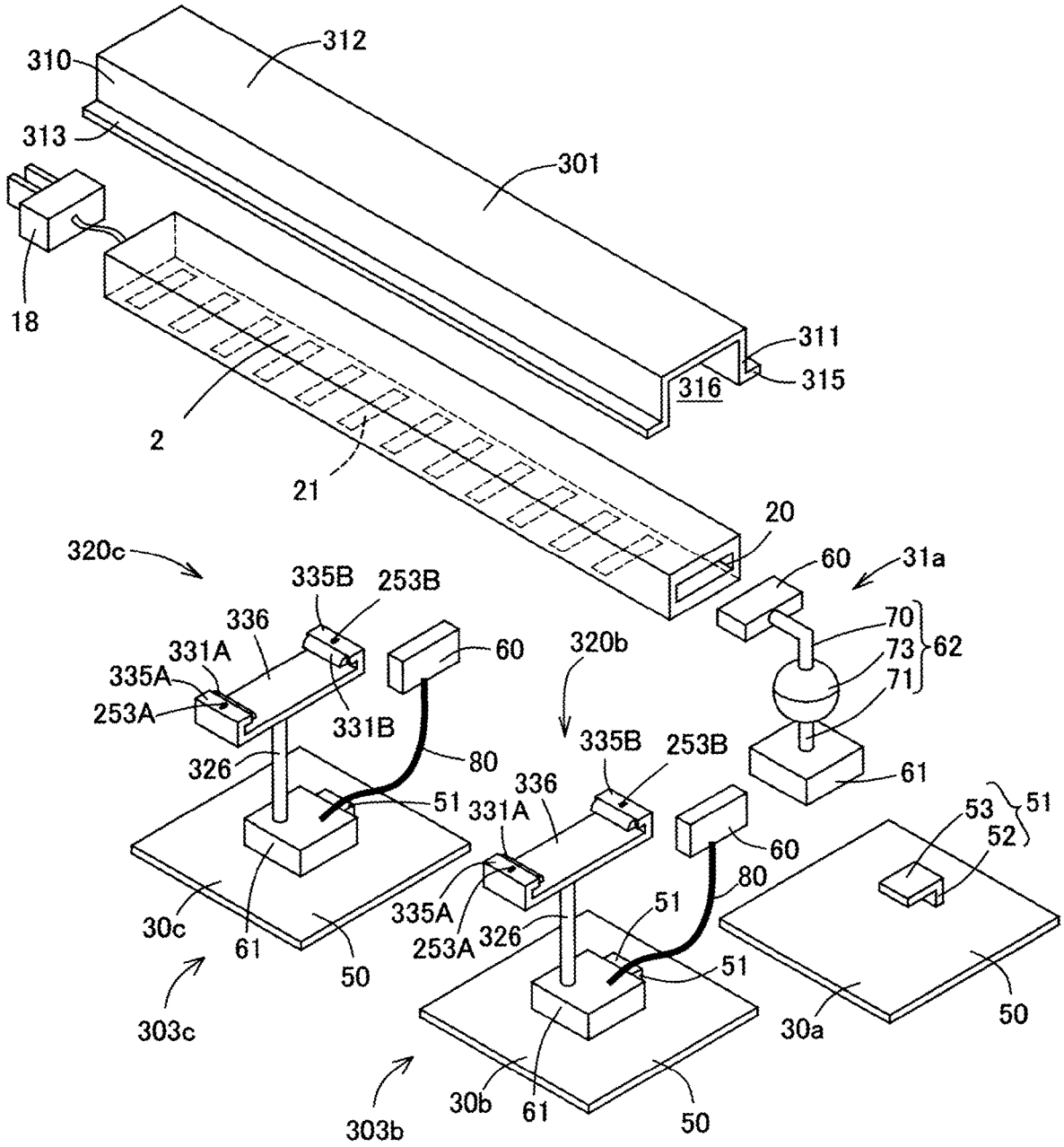
FIG. 22 is an exploded perspective view of the lighting device of FIG. 21.

As shown in FIG. 22, the rail member 301 includes wall portions 310 and 311 facing each other across accommodating space 316, a connecting wall portion 312 connecting ends of the wall portions 310 and 311, and engagement wall portions 313 and 315 projecting toward an outer side from ends of the wall portions 310 and 311.

Figure 23:
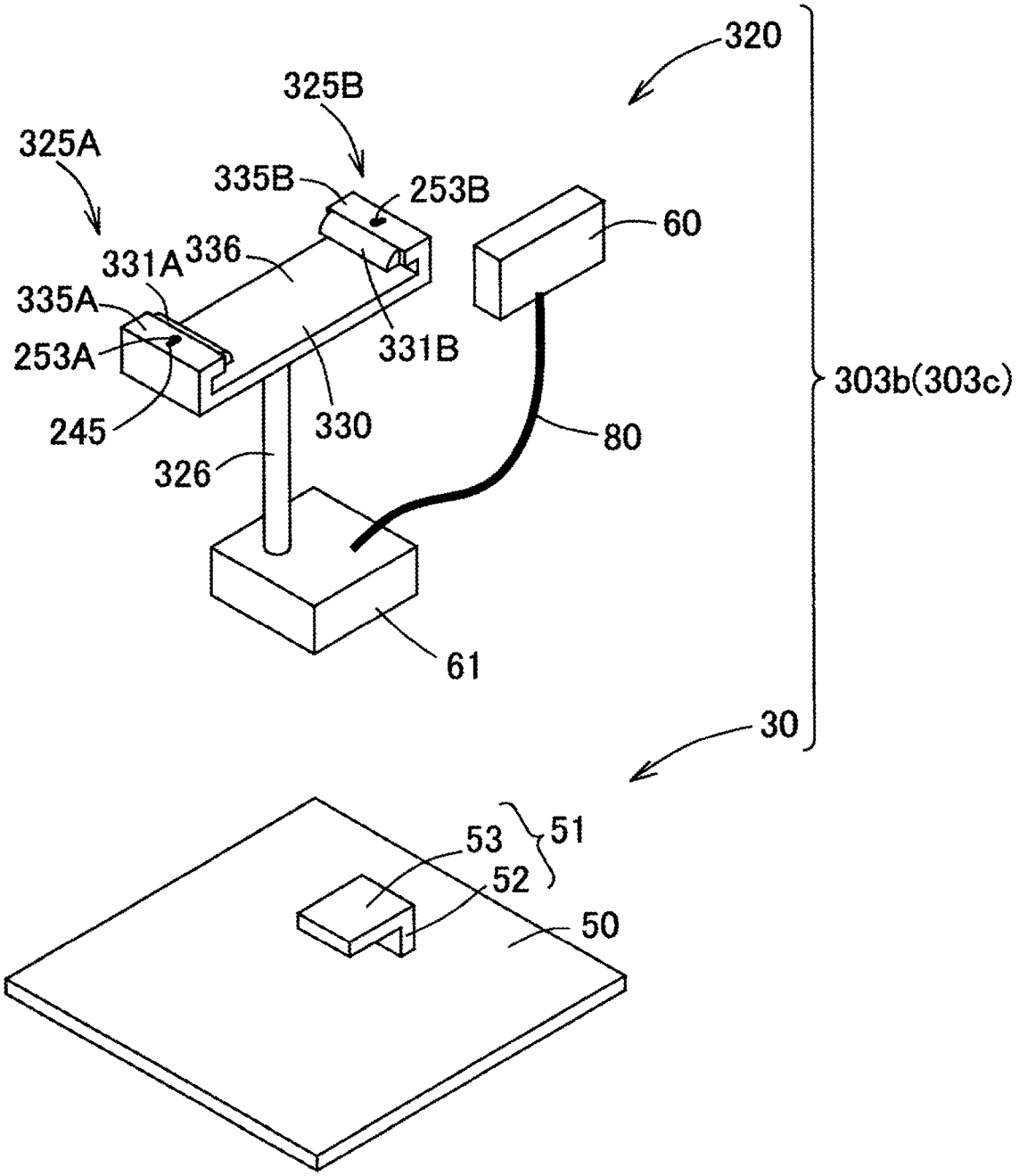
FIG. 23 is an exploded perspective view of the lighting panel of FIG. 22.

The lighting panels 303*b* and 303*c* are configured with a mounting member 320 and planar light-emitting panels 30*b* and 30*c* as shown in FIGS. 22 and 23.

The mounting member 320 includes engagement units 325A and 325B, a connecting part 326, the first attaching side engagement part 60, the second attaching side engagement part 61, and the connecting unit 80.

The engagement units 325A and 325B include a skeleton portion 330, engaging members 331A and 331B, urging members 251A and 251B, and fixing members 253A and 253B.

The skeleton portion 330 includes two accommodating portions 335A and 335B and a connecting unit 336.

The accommodating portions 335A and 335B are casing-like portions capable of accommodating the engaging members 331A and 331B and the urging members 251A and 251B, and include the second restriction grooves 245A and 245B penetrating in a thickness direction.

The connecting unit 336 is a portion which connects the accommodating portions 335A and 335B, and is provided with the first restriction grooves 244A and 244B.

The engaging members 331A and 331B are fall preventing members that are engaged with the rail member 301 to prevent the lighting panels 303*b* and 303*c* from falling, and are provided with the restricting piece 254 and the locking portion 255.

The connecting part 326 is a part which connects the engagement unit 325 and the second attaching side engagement part 61, and is a rod-like body having rigidity.

Next, a positional relationship of each member will be described together with an assembly procedure of the lighting device 300.

First, the insertion part 53 of the panel side engagement part 51 of each of the planar light-emitting panels 30*a* to 30*c* is inserted into the insertion port 65 of the second attaching side engagement part 61 of each of the mounting members 320, and the planar light-emitting panels 30*a* to 30*c* are attached to the mounting members 31*a*, 320*b*, and 320*c*.

In a separate process, the support member 2 is accommodated and fixed in the accommodating space 316 of the rail member 301, and the rail member 301 is fixed to the mounting surface 100 by a fastening element or the like (not shown).

Figure 24A:
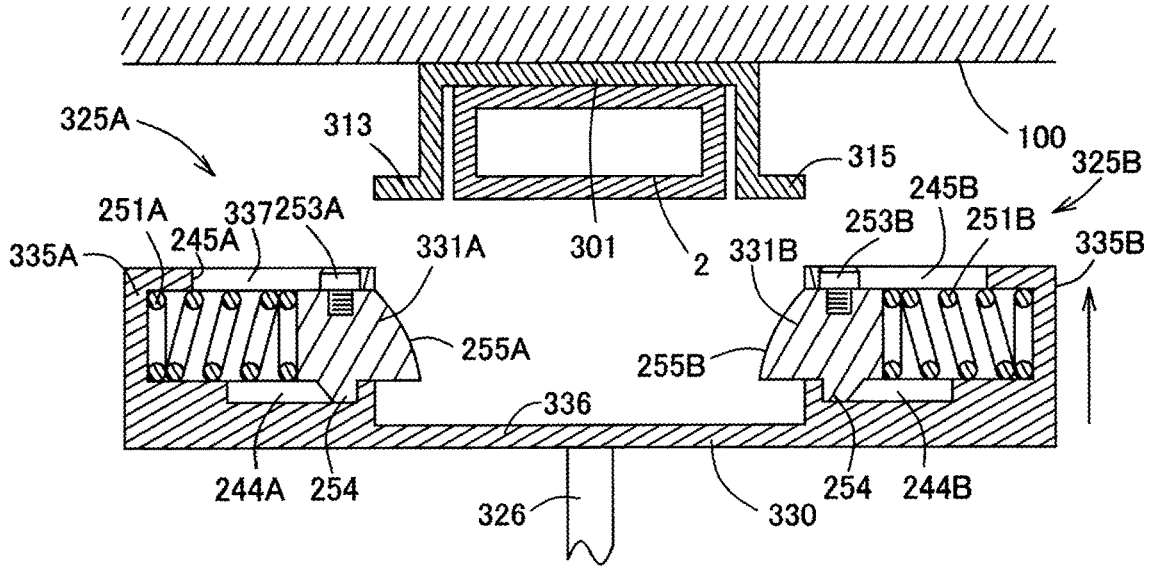
Figure 24B:
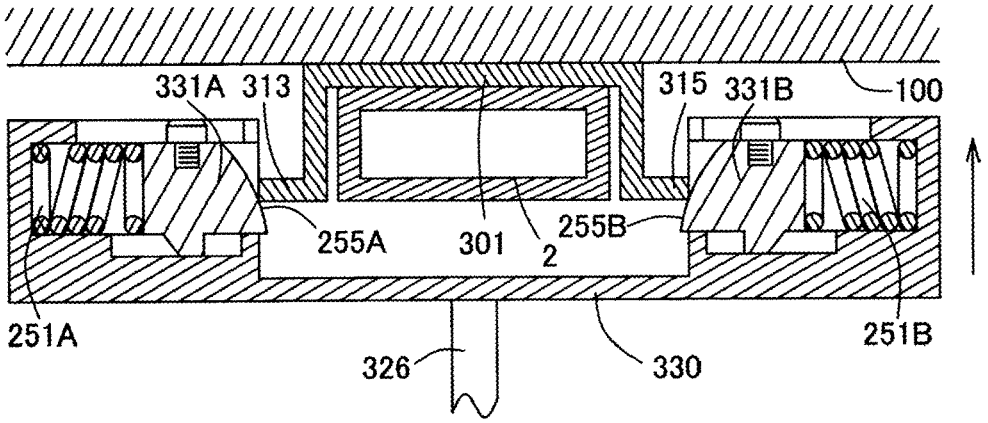
Figure 24C:
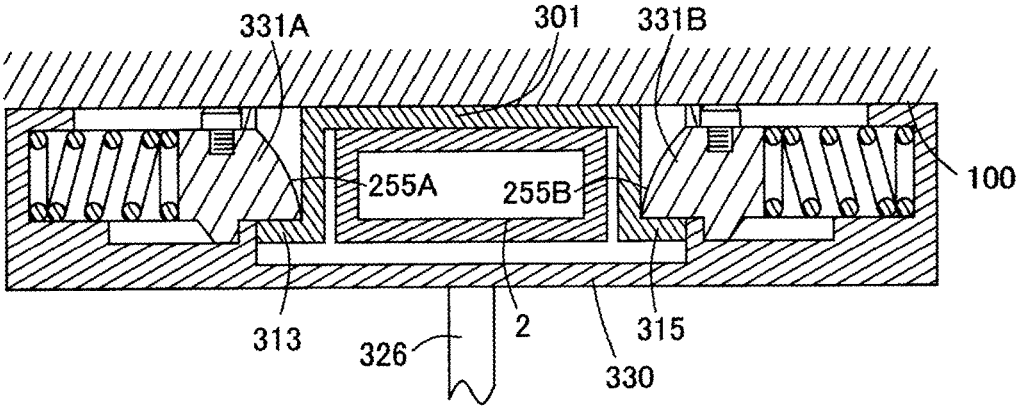

Next, as shown in FIGS. 24A, 24B, and 24C, while the engaging members 331A and 331B of the lighting panel 303*b* (303*c*) are pressed against the engagement wall portions 313 and 315 of the rail member 301, the lighting panel 303*b* (303*c*) is caused to approach the rail member 301, so that the engagement wall portions 313 and 315 are engaged with the engaging members 331A and 331B.

At this time, locking portions 255A and 255B of the engaging members 331A and 331B are pressed by the engagement wall portions 313 and 315, and are separated from each other against the urging force of the urging members 251A and 251B. When the engagement wall portions 313 and 315 move beyond the locking portions 255A and 255B of the engaging members 331A and 331B, the engaging members 331A and 331B are caused to approach by the urging force of the urging members 251A and 251B, and the engaging members 331A and 331B and the engagement wall portions 313 and 315 are engaged in a vertical direction.

When the used planar light-emitting panel 30*b* is removed from the lighting device 300, similar to the lighting device 1 of the first embodiment, the insertion part 53 is pushed into the insertion port 65, and the planar light-emitting panel 30*b* is slid in a direction orthogonal to the support member 2 and pulled out.

Figure 25:
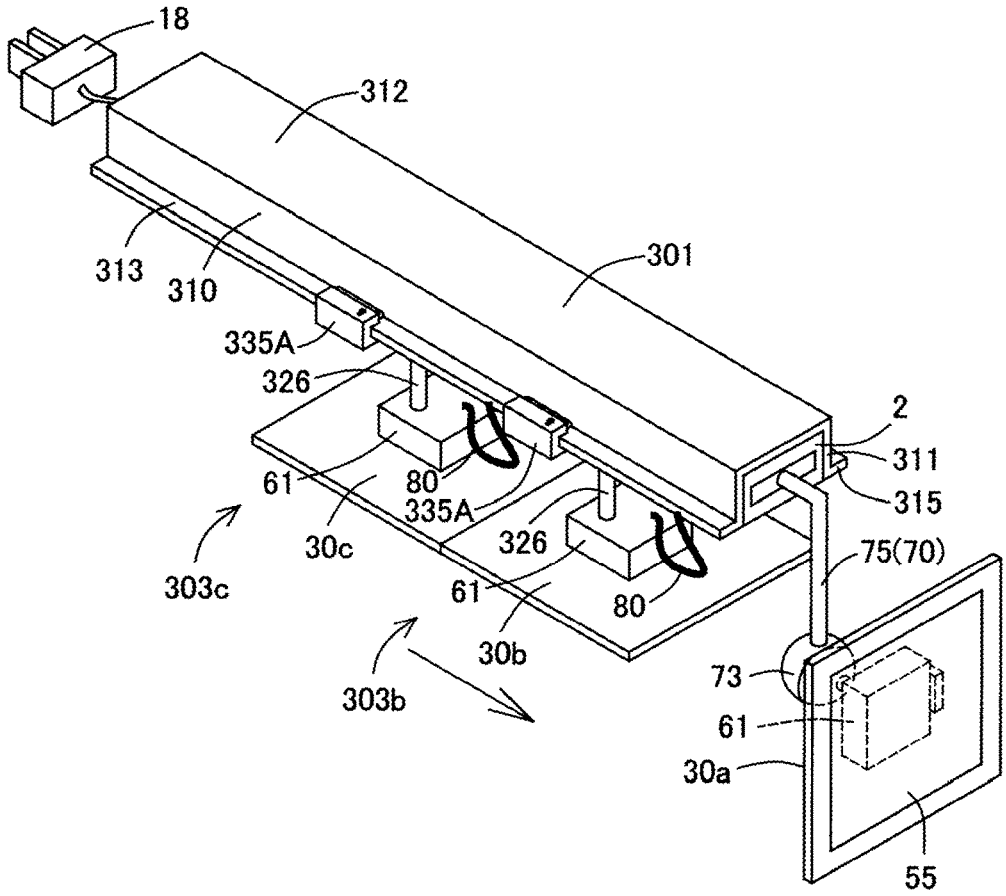
FIG. 25 is a perspective view showing a state in which the lighting panel of FIG. 21 takes a second posture.

In a case of replacing the entire lighting panel 303*b*, as shown in FIG. 25, the first attaching side engagement part 60*b* of the lighting panel 303*b* is pulled out from the side face side engagement part 21 of the support member 2, and the lighting panel 3*a* is set to have the second posture. In this state, the lighting panel 303*b* is slid in the extending direction of the rail member 301, and the engagement unit 325 is removed from the end of the rail member 301.

According to the lighting device 300 of the third embodiment of the present invention, the first attaching side engagement part 60*b* mainly used for power feeding and the engagement unit 325 used for fixation are separately formed, and the connecting portion of the mounting member 320 and the rail member 301 and the connecting portion of the mounting member 320 and the support member 2 are separate portions. For this reason, even if the mounting member 320 is detached from the rail member 301, the state in which the mounting member 320 and the support member 2 are connected can be maintained, and the fall can be prevented.

Figure 26:
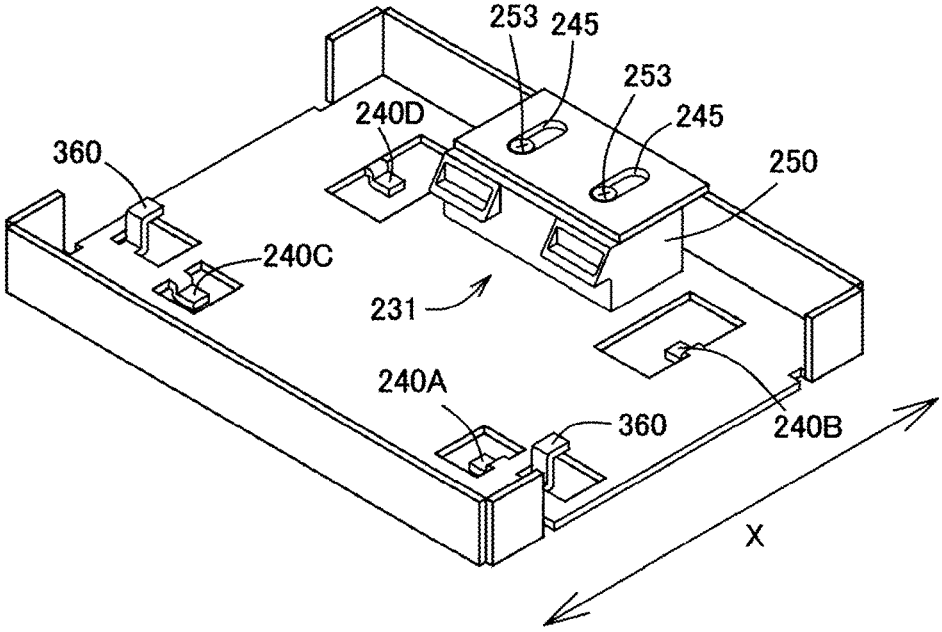
FIG. 26 is a perspective view of the lighting device of a fourth embodiment of the present invention.

In the second and third embodiments described above, the urging member 251 is provided for each of a plurality of the engagement units 231 (in the case of the second embodiment) facing in the width direction X. However, the present invention is not limited to this configuration. As shown in FIG. 26, the configuration may be such that the urging member 251 is provided only in one of the engagement units 231 facing in the width direction X, and the other engagement units are used simply as locking pieces 360 and 360 (fourth embodiment). That is, the locking pieces 360 and 360 are engaged with the engagement wall portion 313 or the engagement wall portion 315 of the rail member 301, and the engagement unit 231 is pressed against the engagement wall portion 315 or the engagement wall portion 313 of the rail member 301. In this manner, the engagement unit 231 provided with the urging member 251 moves relative to the locking pieces 360 and 360 and is engaged with the engagement wall portion 315 or the engagement wall portion 313.

In the above-described third embodiment, the lighting panel 303 is removable from the end of the rail member 301. However, the present invention is not limited to this configuration.

Figure 27A:
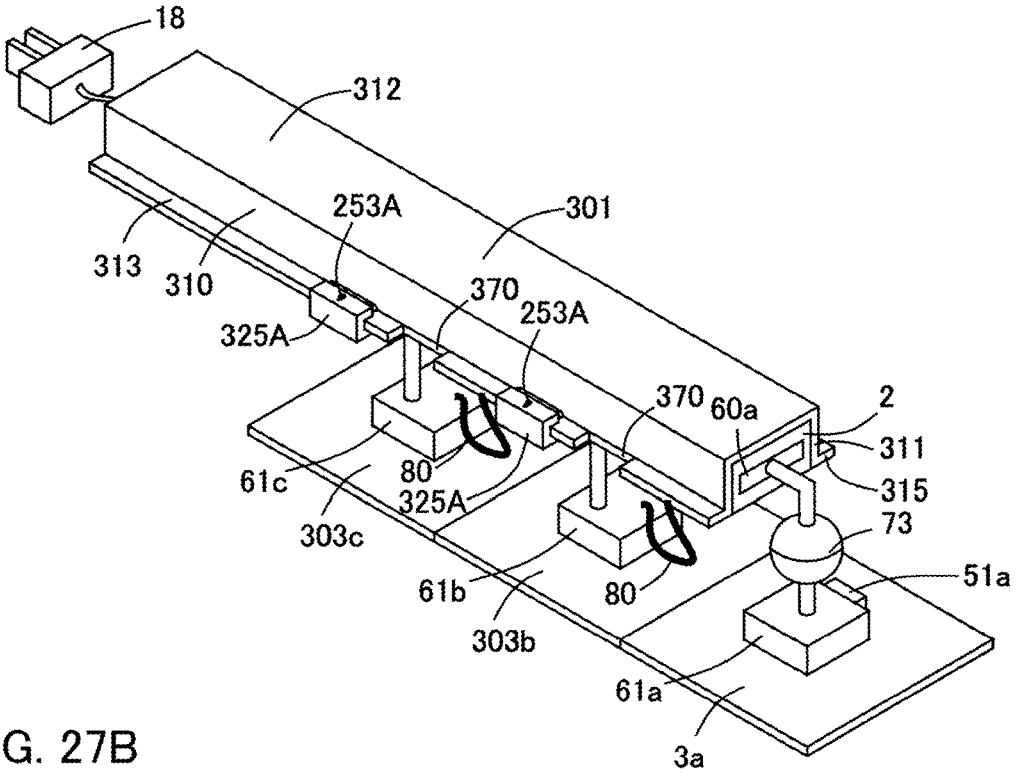
Figure 27B:
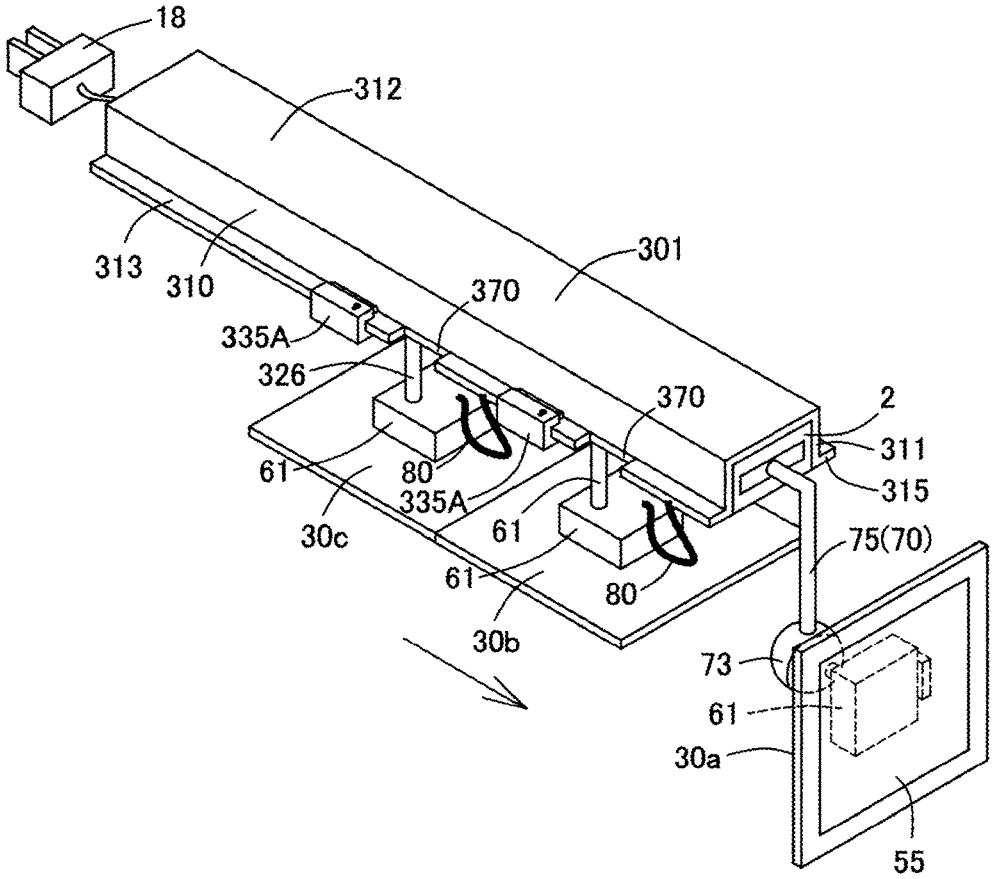

As shown in FIGS. 27A and 27B, the configuration may be such that notches 370 and 370 are provided in the engagement wall portions 313 and 315 of the rail member 301, so that the lighting panel 303 can be removed from the notches 370 and 370 (fifth embodiment). That is, by setting the planar light-emitting panel 30*a* of the lighting panel 3*a* to be in the second posture and moving the lighting panels 303*b* and 303*c* in a longitudinal direction of the rail member 301, the notches 370 and 370 and the engagement units 325A and 325B coincide with each other, and the engagement units 325A and 325B can be removed from the notches 370 and 370.

In the embodiment described above, the insertion direction of the insertion part 53 into the insertion port 65 and the insertion direction of the wiring side connector portions 280, 281, and 284 into the connector portions 221 and 222 are orthogonal to the extending direction of the support member 2 or the rail member 202. However, the present invention is not limited to this configuration, and the insertion directions may be slightly inclined from the orthogonal direction as long as the directions are substantially orthogonal. Similarly, in the embodiment described above, the insertion direction of the first attaching side engagement parts 60*b* and 60*c* into the side face side engagement part 21 and the engaging direction of the rail side engagement parts 270 and 271 and the engaging member 250 are orthogonal to the extending direction of the support member 2 or the rail member 202. However, the present invention is not limited to this configuration, and the directions may be slightly inclined from the orthogonal direction as long as the directions are substantially orthogonal.

In the first embodiment described above, three of the lighting panels 3*a* to 3*c* are connected by the connecting member 5. However, the present invention is not limited to this configuration. Two of the lighting panels 3 may be connected by the connecting member 5, or four or more of the lighting panels 3 may be connected.

Figure 28A:
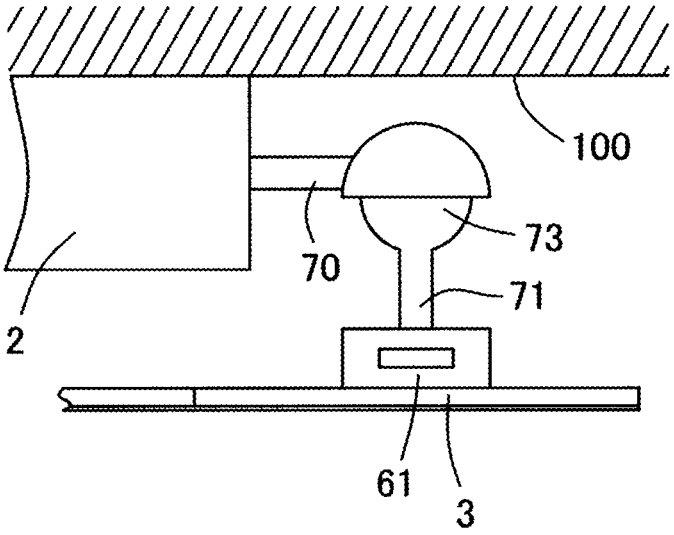
Figure 28B:
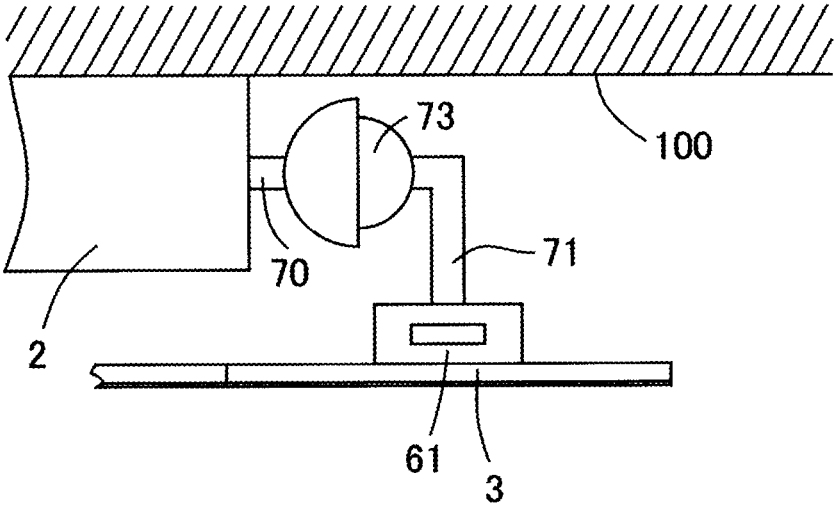

In the first and third embodiments described above, the case where the first connecting unit 70 is bent as the connecting unit 62 is described. However, the present invention is not limited to this configuration. The first connecting unit 70 may extend linearly as shown in FIG. 28A, or the second connecting unit 71 may be bent in an "L" shape as shown in FIG. 28B. Further, the first connecting unit 70 and the second connecting unit 71 may be curved.

Figure 29:
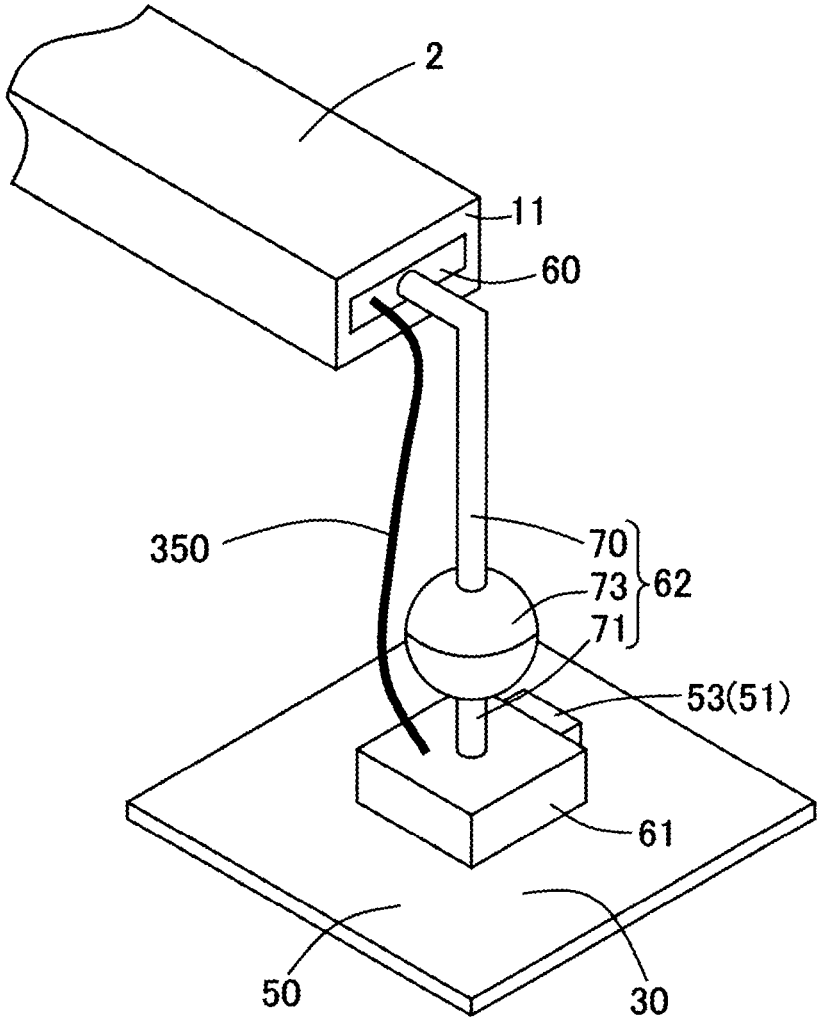
FIG. 29 is a perspective view of a main part of the lighting device of another embodiment of the present invention.

In the first and third embodiments described above, the connecting unit 62 has a power feeding structure, and power can be fed to the planar light-emitting panel 30*a* through the joint part 73. However, the present invention is not limited to this configuration. As shown in FIG. 29, the configuration may be such that a wiring line 350 is provided separately from the connecting unit 62, so that power can be fed to the planar light-emitting panel 30*a* without the joint part 73.

In the first and third embodiments described above, the engagement parts 20 and 21 are female terminals, and the first attaching side engagement part 60 is a male terminal. However, the present invention is not limited to this configuration. The engagement parts 20 and 21 may be male terminals, and the first attaching side engagement part 60 may be a female terminal.

In the embodiment described above, the support member 2 and the rail member 202 extend in a straight line. However, the present invention is not limited to this configuration, and the members only need to extend in a predetermined direction as a whole. That is, a portion may be curved, wavy, or zigzag.

Although the above-mentioned embodiment describes the case where an organic EL panel is used as the planar light-emitting panels 30 and 210, the present invention is not limited to this configuration. The planar light-emitting panels 30 and 210 only need to be one that emits light spread in a plane, and may be, for example, an LED panel in which a plurality of LEDs are scattered in a plane, or an inorganic EL panel.

Although the case where a ceiling surface is used as the mounting surface 100 is described in the above embodiment, the present invention is not limited to this configuration. One surface of another structure, such as a desk, may be used as the mounting surface 100.

In the first embodiment described above, the side face forming portion 14 is attached to face or contact the mounting surface 100 which is a ceiling surface. However, the present invention is not limited to this configuration. Other side face forming portion 13 or side face forming portion 15 may be attached so as to face or contact the mounting surface 100. In these cases, the engagement parts 20 and 21 are preferably attached so as to face substantially in a horizontal direction.

The first embodiment above describes the case where the side face side engagement part 21 is provided in the side face forming portion 12 that forms a bottom surface when the mounting surface 100 is attached. However, the present invention is not limited to this configuration. The side face side engagement part 21 may be provided in the other side face forming portions 13 to 15.

In the above-described embodiments, each component member can be freely replaced or added between the embodiments as long as they are included in the technical scope of the present invention.

EXPLANATION OF REFERENCE CHARACTERS

1, 200, 300: Lighting device
2: Support member
3*a*, 201, 303*a*: Lighting panel (second lighting panel)
3*b*, 3*c*, 303*b*, 303*c*: Lighting panel
20: End face side engagement part (support side engagement part)
21, 21A-21L: Side face side engagement part (support side engagement part)
22, 265: Wiring space
25: Feeding wiring line
30*a*: Planar light-emitting panel (second planar light-emitting panel)
30*b*, 30*c*, 210: Planar light-emitting panel
31*a*: Mounting member (second mounting member)
31*b*, 31*c*: Mounting member

51: Panel side engagement part
55: Emission surface
60: First attaching side engagement part
61: Second attaching side engagement part
70: First connecting unit
71: Second connecting unit
202: Rail member (support member)
203: First wiring member (feeding wiring line)
204: Second wiring member (feeding wiring line)
211: Mounting member
217: First connecting unit
218: Second connecting unit
231, 231A to 231D, 325, 325A, 325B: Engagement unit
250, 331, 331A, 331B: Engaging member (engaging piece)
251, 251A, 251B: Urging member
270, 271: Rail side engagement part (support side engagement part)
313, 315: Engagement wall portion (support side engagement part)

The invention claimed is:

1. A lighting device, comprising:

a first lighting panel;

a support member extending in a predetermined direction; and a feeding wiring line configured to feed power to the first lighting panel, the support member having a support side engagement part, the feeding wiring line being mostly covered with the support member, the first lighting panel including:

a planar light-emitting panel having an emission surface; and a mounting member that attaches the planar light-emitting panel to the support member, wherein the planar light-emitting panel is attachable to and detachable from the mounting member, the planar light-emitting panel having a panel side engagement part on a rear surface thereof, wherein the mounting member is fixable to the support member at a plurality of positions in an extending direction of the support member, the mounting member having a first attaching side engagement part and a second attaching side engagement part, wherein the first attaching side engagement part is engageable with the support side engagement part at a position overlapping with the planar light-emitting panel when the emission surface is viewed from a direction in front of the emission surface, the first attaching side engagement part being engageable with the support side engagement part in a direction substantially orthogonal to the extending direction of the support member, wherein the second attaching side engagement part is engageable with or disengageable from the panel side engagement part in the direction substantially orthogonal to the extending direction of the support member, wherein the support member has a plurality of the support side engagement parts provided at an interval in the predetermined direction, wherein the mounting member has a first attaching side engagement part engageable with each of the plurality of the support side engagement parts, and wherein a position of the first lighting panel with respect to the support member is adjustable by disengaging the first attaching side engagement part from one support side engagement part of the plurality of support side engagement parts and engaging with a different support side engagement part of the plurality of support side engagement parts;

wherein the lighting device further comprises a second lighting panel provided in parallel with and adjacent to the first lighting panel in the extending direction of the support member, wherein the second lighting panel includes a second planar light-emitting panel having an emission surface, and a second mounting member having a first connecting unit and a second connecting unit, wherein the second connecting unit connected to the second planar light-emitting panel is configured to change a posture with respect to the first connecting unit, and wherein the second lighting panel is capable of changing its posture to a first posture and to a second posture by changing a posture of the second connecting unit with respect to the first connecting unit, the first posture being a posture in which the emission surface of the second planar light-emitting panel faces an identical direction to the emission surface of the planar light-emitting panel of the first lighting panel, the second posture being a posture in which the emission surface of the second planar light-emitting panel faces a direction substantially orthogonal to the extending direction.

2. The lighting device according to claim 1, wherein at least one support side engagement part of the plurality of support side engagement parts is electrically connected to the feeding wiring line, the at least one support side engagement part being fittable to the first attaching side engagement part, and wherein the first lighting panel and the feeding wiring line are electrically connected when the at least one support side engagement part is fitted to the first attaching side engagement part.

3. The lighting device according to claim 1, wherein the support member includes at least two support side engagement parts of the plurality of support side engagement parts, wherein the at least two support side engagement parts are each electrically connected to the feeding wiring line and are each fittable to the first attaching side engagement part, and wherein the first lighting panel and the feeding wiring line are electrically connected when the first attaching side engagement part is fitted to at least one of the at least two support side engagement parts.

4. The lighting device according to claim 1, wherein the first attaching side engagement part includes an engagement unit including an engaging piece and at least one resilient member, and wherein when the mounting member is attached to the support member, the engaging piece is urged toward the support member by the at least one resilient member, so that the engaging piece is engaged with at least one support side engagement part of the plurality of support side engagement parts.

5. The lighting device according to claim 4, wherein the support member includes at least two support side engagement parts of the plurality of support side engagement parts, the at least two support side engagement parts including a first and a second support side engagement part, wherein the mounting member includes two of the engagement units, the two of the engagement units including a first and a second engagement unit, the first engagement unit including a first engaging piece and a first resilient member of the at least one resilient member, the second engagement unit including a second engaging piece and a second resilient member of the at least one resilient member, wherein the first and the second engaging pieces face each other with a space in-between so as to be urged to approach each other by the first and the second resilient members of the at least one resilient member respectively, and wherein when the mounting member is attached to the support member, the support member is partially located between the first and the second engagement units while the first and the second support side engagement parts are engaged with the first and the second engaging pieces respectively.

6. The lighting device according to claim 1, wherein the mounting member of the first lighting panel is movable in the extending direction when the second lighting panel takes the second posture.

7. The lighting device according to claim 1, wherein the lighting device further comprises a connecting member that performs connection so that the emission surface of the first lighting panel and the emission surface of the second lighting panel are positioned on an identical plane.

8. The lighting device according to claim 7, wherein the connecting member is formed of a flexible transparent resin, wherein the emission surface of the planar light-emitting panel is at least partially visible through the connecting member, and wherein the planar light-emitting panel is removable from the mounting member by elastically deforming the connecting member.

* * * * *